US012256845B2

(12) United States Patent
Haarstad et al.

(10) Patent No.: US 12,256,845 B2
(45) Date of Patent: Mar. 25, 2025

(54) ADJUSTABLE FIRMNESS MATTRESS SYSTEM

(71) Applicant: Haarstad Innovative Systems LLC, Chanhassen, MN (US)

(72) Inventors: Philip J Haarstad, Chanhassen, MN (US); Molly Haarstad, Natchitoches, LA (US); Alexander Haarstad, Natchitoches, LA (US); Benjamin Haarstad, Chaska, MN (US); Connie Marie Haarstad, Eden Prairie, MN (US); Donald Melvin Haarstad, Champlin, MN (US); Laura K Y Haarstad, Chanhassen, MN (US); Lucas G Haarstad, Chanhassen, MN (US); Paul A Haarstad, Eden Prairie, MN (US); Dennis Nathaniel Harvey, Norwood Young America, MN (US); Anthony Todd Hessburg, Minnetrista, MN (US); Ching Hung, Maple Grove, MN (US); Heidi J Hung, Maple Grove, MN (US); Shawn M Patterson, East Aurora, NY (US); Elizabeth Kate Radzwill, White Bear Lake, MN (US); Rockford Kenneth White, Woodbury, MN (US)

( * ) Notice: Subject to any disclaimer, the term of this patent is extended or adjusted under 35 U.S.C. 154(b) by 165 days.

(21) Appl. No.: 17/588,251

(22) Filed: Jan. 29, 2022

(65) Prior Publication Data

US 2022/0240687 A1 Aug. 4, 2022

Related U.S. Application Data

(60) Provisional application No. 63/143,937, filed on Jan. 31, 2021.

(51) Int. Cl.
*A47C 27/14* (2006.01)
*A47C 27/15* (2006.01)
*A47C 31/12* (2006.01)

(52) U.S. Cl.
CPC ..... *A47C 27/148* (2013.01); *A47C 27/146* (2013.01); *A47C 27/15* (2013.01); *A47C 31/123* (2013.01)

(58) Field of Classification Search
CPC ... A47C 27/148; A47C 27/146; A47C 31/123; A47C 27/144; A47C 27/142; A47C 27/15; A61G 7/05715
See application file for complete search history.

(56) References Cited

U.S. PATENT DOCUMENTS 3,252,170 A 5/1966 Frye
6,061,856 A * 5/2000 Hoffmann ..... A47C 27/148 5/724

(Continued)

FOREIGN PATENT DOCUMENTS

CN 209252178 U * 8/2019
CN 209734391 U 12/2019

(Continued)

OTHER PUBLICATIONS

International Search Report and Written Opinion for Application No. PCT/US2022/014631, dated May 10, 2022.

*Primary Examiner* — Justin C Mikowski
*Assistant Examiner* — Alison N Labarge
(74) *Attorney, Agent, or Firm* — McKinley IP LLC

(57) ABSTRACT

Apparatuses, components, devices, methods, and systems for an adjustable firmness mattress are provided. An example rectangular shaped adjustable firmness mattress extends lengthwise from a head end to a foot end, widthwise from a first side to a second side, and depth-wise from a top side to a bottom side. The example mattress may include an (Continued)

adjustable firmness support layer disposed between the bottom side of the mattress and the top side of the mattress. The adjustable firmness support layer may include at least one rotatable assembly having an orientation-specific firmness, a bridge assembly disposed between the at least one rotatable assembly and the top side of the mattress; and a support assembly disposed between the at least one rotatable assembly and the bottom side of the mattress.

19 Claims, 20 Drawing Sheets

(56) References Cited

U.S. PATENT DOCUMENTS

| | | | | |
|---|---|---|---|---|
| 6,212,718 | B1 | 1/2001 | Stolpmann et al. | |
| 7,661,166 | B1 | 2/2010 | Marling et al. | |
| 8,245,341 | B2 | 8/2012 | Oh | |
| 9,848,712 | B2 | 12/2017 | Main et al. | |
| 10,624,465 | B2 | 4/2020 | Dahlin | |
| 2008/0201856 | A1* | 8/2008 | Howard | A47C 31/123 5/690 |
| 2011/0258772 | A1 | 10/2011 | Verschuere et al. | |
| 2014/0208519 | A1 | 1/2014 | Balonick | |
| 2016/0220031 | A1 | 2/2016 | Rawls-Meehan et al. | |
| 2016/0029811 | A1 | 8/2016 | Alzoubi et al. | |
| 2018/0255937 | A1 | 9/2018 | Longman et al. | |
| 2018/0255941 | A1 | 9/2018 | Longman et al. | |
| 2018/0289181 | A1* | 10/2018 | DeMore | A47G 9/109 |
| 2022/0192391 | A1* | 6/2022 | Kappenman | A47C 27/148 |

FOREIGN PATENT DOCUMENTS

| | | | | |
|---|---|---|---|---|
| EP | 1680987 | A1 * | 7/2006 | A47C 27/0456 |
| EP | 2745745 | B1 | 6/2014 | |
| GB | 2044091 | A * | 10/1980 | A47C 27/146 |
| KR | 101471607 | B1 * | 12/2014 | A47C 27/148 |
| WO | 2015144836 | A1 | 10/2015 | |
| WO | 20161380828 | A1 | 9/2016 | |

* cited by examiner

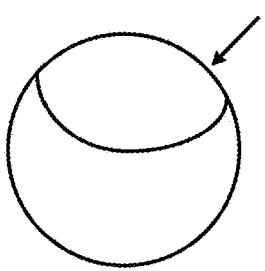
FIG. 11A
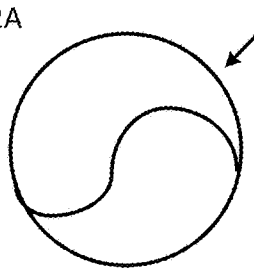
FIG. 11B
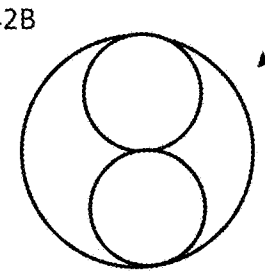
FIG. 11C
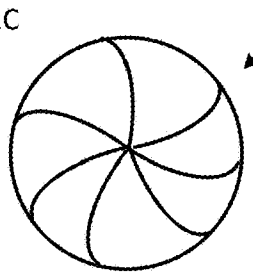
FIG. 11D
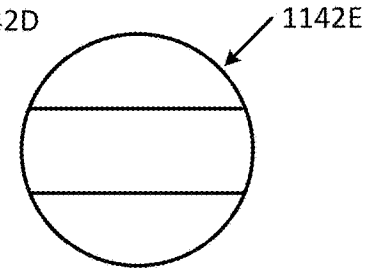
FIG. 11E
FIG. 11F
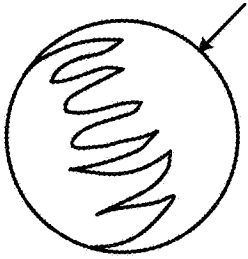
FIG. 11G
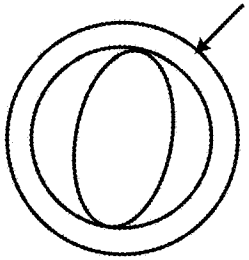
FIG. 11H
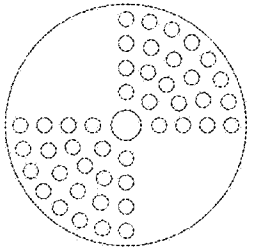
FIG. 11I
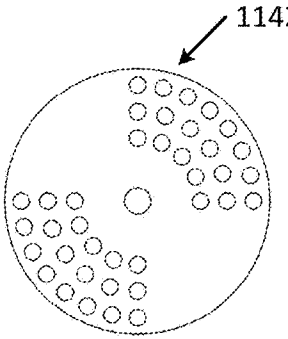
FIG. 11J
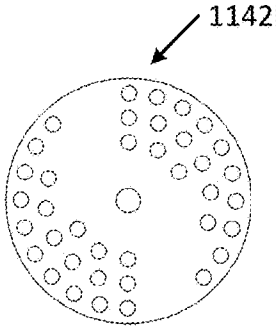
FIG. 11K
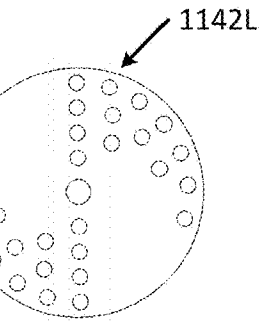
FIG. 11L
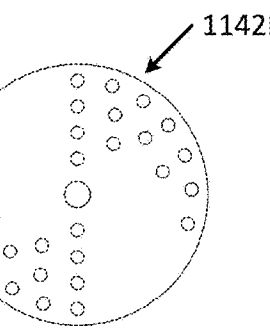
FIG. 11M
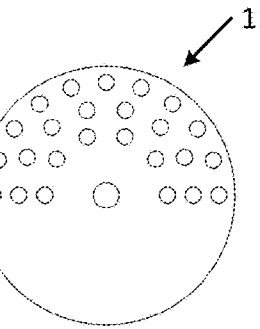
FIG. 11N

ADJUSTABLE FIRMNESS MATTRESS SYSTEM

CROSS REFERENCE TO RELATED APPLICATIONS

This application claims priority, as appropriate, to U.S. Ser. No. 63/143,937, titled "ADJUSTABLE FIRMNESS MATTRESS SYSTEM" and filed Jan. 31, 2021, the disclosure of which is hereby incorporated by reference in its entirety.

BACKGROUND

A mattress is a cushioned structure used to support a reclining body. For example, a mattress is often used for resting or sleeping. Typically, a mattress is a rectangular pad. Mattresses come in various sizes and thicknesses, which may be selected based on the size and preferences of the intended user or users.

Mattresses and other types of cushioned structures are available in various firmness levels. The firmness of the mattress refers to the deflection properties of the mattress as force is applied to the top surface (e.g., by a body reclining on the mattress). A firmer mattress will deflect less than a softer mattress under the same load.

The firmness level may be determined based on properties of the materials used in the mattress. For example, the type and density of foams used in a mattress can alter the firmness of the mattress. As another example, the gauge of wire used in mattress springs can alter the stiffness of the spring and, in turn, the firmness of the mattress.

The desired firmness of a mattress varies from person to person based on many factors such as the person's size, weight, age, health or injury conditions, and preferences. Often two people who share a mattress may desire a different level of firmness. Furthermore, over time, a person's desired mattress firmness may change due to aging, changes in weight or health conditions, or life events such as becoming pregnant.

Some mattresses provide for adjustment of firmness using one or more air bladders. Some of these mattresses may allow for individual adjustment of firmness of each side using separately controllable air bladders. The firmness of an air bladder may change over time for many reasons, such as leaks. Additionally, the pump systems used to adjust the firmness of an air bladder may be noisy.

SUMMARY

In general terms, this disclosure is directed to an adjustable firmness mattress system. In one possible configuration and by non-limiting example, a mattress includes a roller assembly attached to and configured to rotate one or more compressible elements that have an orientation-specific firmness.

One aspect is a rectangular shaped adjustable firmness mattress that extends lengthwise from a head end to a foot end, widthwise from a first side to a second side, and depth-wise from a top side to a bottom side, the mattress comprising: an adjustable firmness support layer disposed between the bottom side of the mattress and the top side of the mattress, the adjustable firmness support layer including: at least one rotatable assembly having an orientation-specific firmness; a bridge assembly disposed between the at least one rotatable assembly and the top side of the mattress; and a support assembly disposed between the at least one rotatable assembly and the bottom side of the mattress.

Another aspect is a rectangular shaped adjustable firmness mattress that extends lengthwise from a head end to a foot end, widthwise from a first side to a second side, and depth-wise from a top side to a bottom side, the mattress comprising: a comfort layer that includes a layer of padding; an adjustable firmness support layer disposed between the bottom side of the mattress and the comfort layer the adjustable firmness support layer including a plurality of rotatable assemblies; and a fabric covering that encloses the comfort layer and the support layer.

Yet another aspect is A rectangular shaped adjustable firmness mattress that extends lengthwise from a head end to a foot end, widthwise from a first side to a second side, and depth-wise from a top side to a bottom side, the mattress comprising: a comfort layer that includes a layer of padding; an adjustable firmness support layer disposed between the bottom side of the mattress and the comfort layer the adjustable firmness support layer including: a plurality of rotatable assemblies, the rotatable assemblies including central axles with a plurality of compressible elements mounted along the central axles, the compressible elements having an orientation-specific firmness; a bridge assembly disposed between the plurality of rotatable assemblies and the top side of the mattress and configured to distribute force applied to the top side of the mattress across multiple of the plurality of rotatable assemblies, the bridge assembly having multiple bridge wedges shaped to fit between adjacent compressible elements; and a support assembly disposed between the plurality of rotatable assemblies and the bottom side of the mattress, the support assembly having multiple support wedges shaped to fit between adjacent compressible elements and formed from a foam material that is more rigid than the compressible element; and a fabric covering that encloses the comfort layer and the support layer.

The details of one or more aspects are set forth in the accompanying drawings and description below. Other features and advantages will be apparent from a reading of the following detailed description and a review of the associated drawings. It is to be understood that the following detailed description is explanatory only and is not restrictive of this disclosure.

BRIEF DESCRIPTION OF THE DRAWINGS

FIGS. 11A-N are schematic diagrams of example compressible elements according to embodiments described herein.

DETAILED DESCRIPTION

Figure 1:
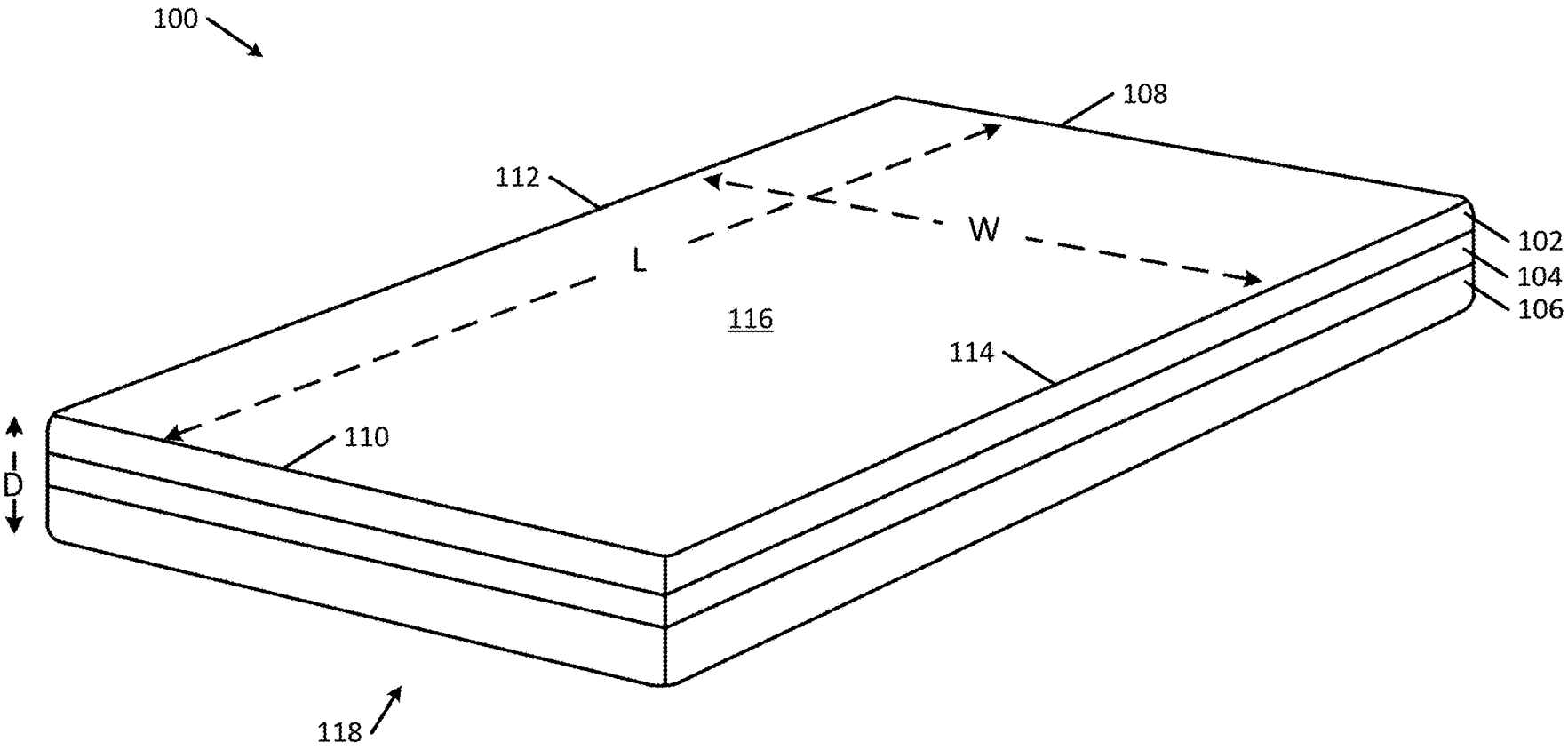
FIG. 1 is a schematic diagram of an adjustable firmness mattress according to embodiments described herein.

Various embodiments will be described in detail with reference to the drawings, wherein like reference numerals represent like parts and assemblies throughout the several views. Reference to various embodiments does not limit the scope of this disclosure. Additionally, any examples set forth in this specification are not intended to be limiting and merely set forth some of the many possible embodiments for this disclosure.

The present disclosure relates to an adjustable firmness mattress system. For example, the system may include multiple rotatable assemblies that have an orientation-specific firmness. An individual may adjust the firmness of regions of the mattress by rotating one or more of the rotatable assemblies. As an example, a rotatable assembly may include multiple disk-like compressible elements that are mounted on a central axle. The rotatable assembly can rotate about the central axle. In some implementations, the central axle is oriented widthwise. The disk-like compressible elements of adjacent rotatable assemblies may be interleaved with one another to reduce gaps. A bridge assembly may be disposed above the rotatable assemblies to distribute force from a reclining body onto the top portions of the rotatable assemblies. A support assembly may be disposed beneath the rotatable assemblies to support the axles of the rotatable assemblies and minimize the amount of force from a reclining body that causes compression of the lower portions of the rotatable assemblies. In this manner, the material properties of the top portions of the compressible elements significantly impact the firmness of the mattress, while the material properties of the bottom portions minimally impact the firmness. In some implementations, the axles include a central rotatable pivot that allows for each side of the mattress to be independently adjusted to accommodate differing firmness preferences of two individuals. In some implementations, the rotatable assemblies span approximately half of the width of the mattress to allow for individual adjustment of each side of the mattress. In at least some of these implementations, a foam panel may run lengthwise through the middle of the mattress to separate the two sides.

FIG. 1 is a schematic diagram of an adjustable firmness mattress 100 according to embodiments described herein. The adjustable firmness mattress 100 is a rectangular pad that is configured to provide support to a reclining body.

The adjustable firmness mattress 100 includes a comfort layer 102, a transition layer 104, and an adjustable firmness support layer 106. The adjustable firmness mattress 100 may also include a fabric covering (not shown in FIG. 1) that encloses the comfort layer 102, the transition layer 104, and the adjustable firmness support layer 106.

The adjustable firmness mattress 100 extends lengthwise (L) from a head end 108 to a foot end 110 and widthwise (W) from a first side 112 to a second side 114. The adjustable firmness mattress 100 extends depth-wise (D) from a top side 116 to a bottom side 118.

The comfort layer 102, transition layer 104, and adjustable firmness support layer 106 are rectangular and stacked depth-wise, with the comfort layer 102 nearest the top side 116 and the adjustable firmness support layer 106 nearest the bottom side 118. Although shown as separate components in FIG. 1, in at least some embodiments the comfort layer 102 and the transition layer 104 are combined as a single layer.

The comfort layer 102 is a soft, flexible layer that provides comfort and cushioning to a reclining body on the adjustable firmness mattress 100. For example, the comfort layer 102 may be softer than the transition layer 104 and the adjustable firmness support layer 106. The comfort layer 102 may include one or more layers of padding. The layers of padding may include polyurethane foam, viscoelastic foam, latex or synthetic latex foam, felt, polyester fiber, cotton fiber, wool fiber, down or imitation down, and non-woven fiber pads.

In some implementations, the comfort layer 102 may also include an active temperature control system, and various sensors, including temperature and pressure sensors. The sensors may be used to determine pressure points and suggest adjustments to the firmness of the mattress. The sensors may also be used to determine a heart rate, heart rate variability, or breathing rate of a person lying in the bed. The measurements made from the sensors may be used to infer whether the person lying in the bed is sleeping.

The transition layer 104 may be firmer and more rigid than the comfort layer 102. The transition layer 104 may be configured to separate the comfort layer 102 from the adjustable firmness support layer 106 and prevent the softer more flexible materials of the comfort layer 102 from deforming into any softer (or less supported) regions of the adjustable firmness support layer 106. The transition layer 104 may include one or more layers of padding. The layers of padding may include polyurethane foam, viscoelastic foam, latex or synthetic latex foam, felt, polyester fiber, cotton fiber, wool fiber, down or imitation down, and non-woven fiber pads. In some implementations, the comfort layer 102 is made from a first foam and the transition layer 104 is made from a second foam that has a higher Indentation Load Deflection (ILD) than the first foam. ILD is a measurement that refers to the pressure required to indent a piece of compressible material (e.g., a foam material) by a specific amount. For example, an ILD measurement may refer to the amount of pressure required to indent a 4-inch-thick piece of material by 1 inch. The ILD measurement can be used to compare different materials. A higher density foam will generally have a higher ILD than a lower density foam made of the same material. In some implementations, the first foam may be a lower density foam than the second foam.

The adjustable firmness support layer 106 includes rotatable components that allow for adjustment of the firmness of the adjustable firmness mattress 100. Embodiments of the adjustable firmness support layer 106 are illustrated and discussed throughout this disclosure.

In some implementations, the adjustable firmness mattress 100 may include a spring layer that includes springs such as innersprings. The spring layer may be disposed beneath the adjustable firmness layer, within the transition layer, or elsewhere.

Figure 2A:
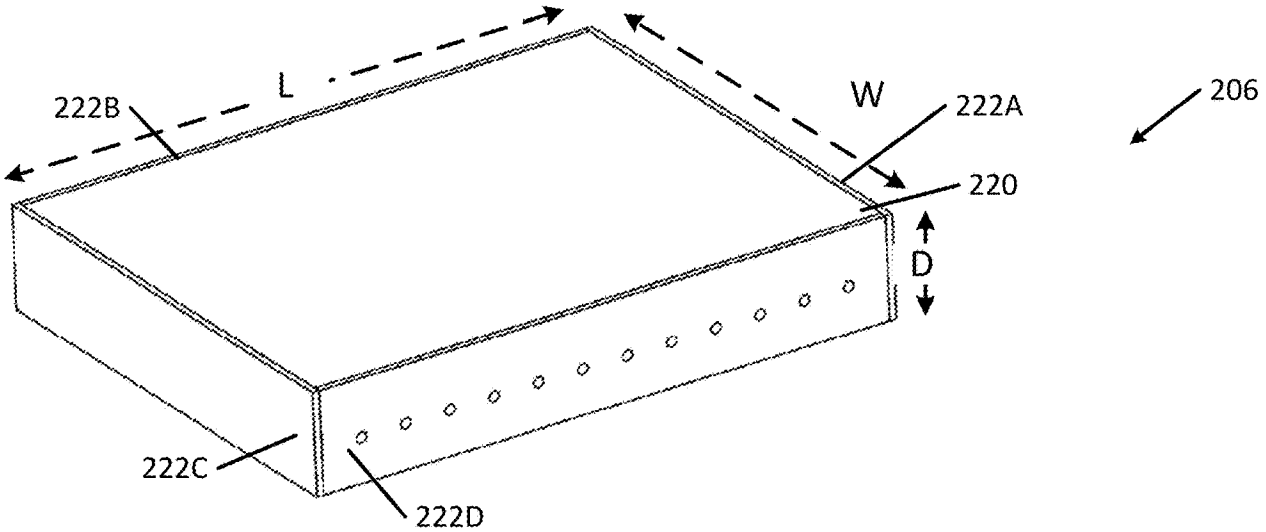
FIGS. 2A and 2B are schematic diagrams of an example adjustable firmness support layer according to embodiments described herein.
Figure 2B:
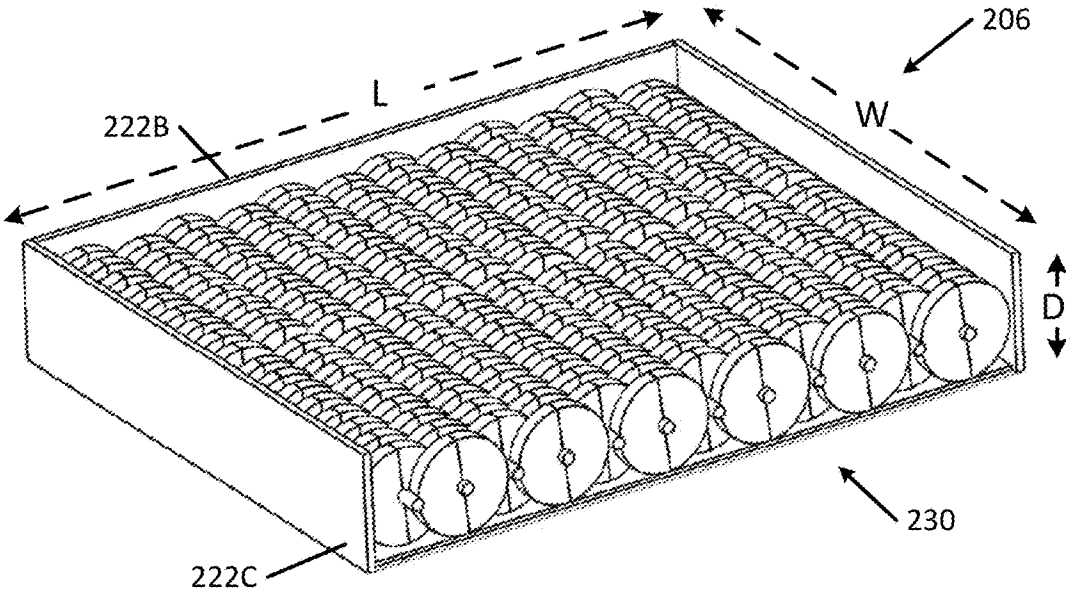

FIGS. 2A and 2B are schematic diagrams of an example adjustable firmness support layer 206 according to embodiments described herein. The adjustable firmness support layer 206 is an example of the adjustable firmness support layer 106. In this example, the adjustable firmness support layer 206 includes an enclosure structure 220 and an internal adjustable firmness structure 230. In FIG. 2A, the enclosure structure 220 obscures viewing the internal adjustable firmness structure 230. In FIG. 2B portions of the enclosure structure 220 are not shown so as to permit viewing of the internal adjustable firmness structure 230.

The enclosure structure 220 encloses at least a portion of the internal adjustable firmness structure 230. For example, the enclosure structure 220 includes side panels 222A, 222B, 222C, and 222D (referred to collectively as side panels 222). Here, the side panels 222A and 222C extend widthwise along the head end 108 and the foot end 110, respectively; and the side panels 222B and 222D extend lengthwise along the first side 112 and the second side 114, respectively.

The side panels 222 may be formed from a foam material. The foam material may have a firmness that is similar to the maximum firmness of the internal adjustable firmness structure 230 to provide a rigid structure along the edges of the adjustable firmness support layer 206. The side panels 222 may be rectangular shaped and may include interlocking cut-outs (or teeth) on adjacent edges so as to fit together and support each other.

Figure 3A:
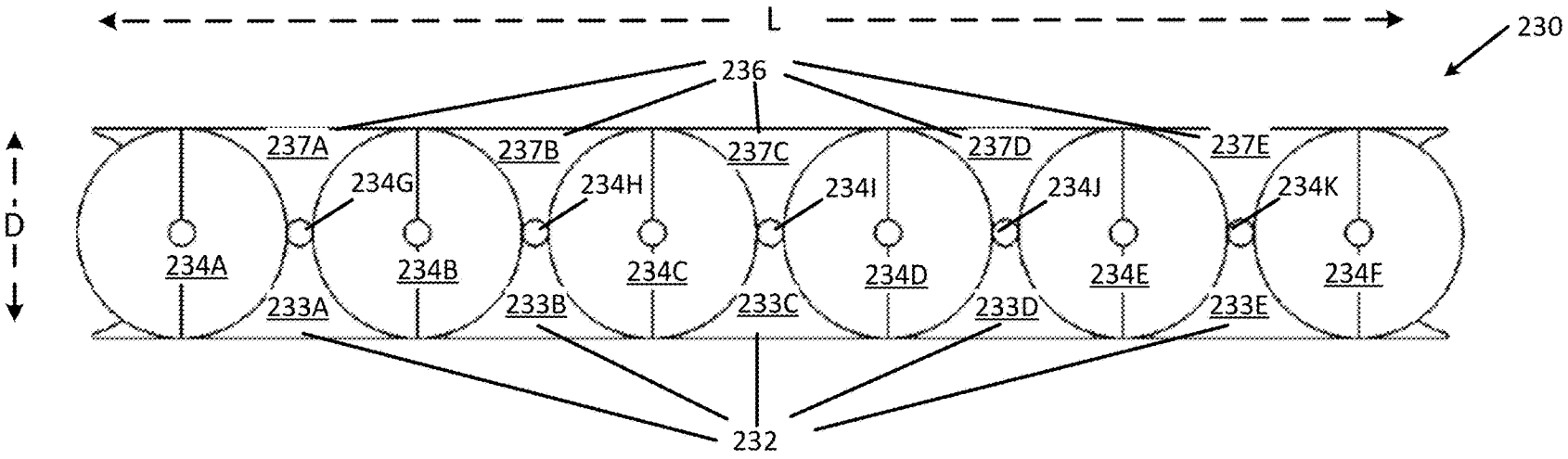
FIGS. 3A and 3B are schematic diagrams of an example adjustable firmness structure according to embodiments described herein.
Figure 3B:
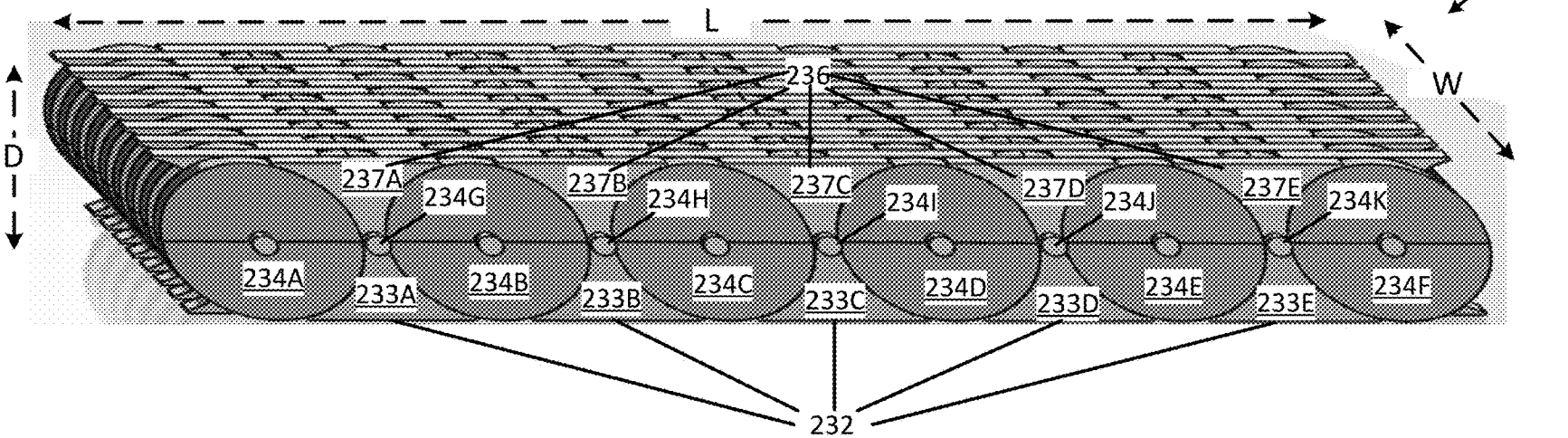

Referring now to FIGS. 3A and 3B, the internal adjustable firmness structure 230 is illustrated. FIG. 3A is a side view of the internal adjustable firmness structure 230, and FIG. 3B is an orthographic projection of the internal adjustable firmness structure 230. In this example, the internal adjustable firmness structure 230 includes a support assembly 232, rotatable assemblies 234A, 234B, 234C, 234D, 234E, 234F, 234G, 234H, 234I, 234J, and 234K (referred to collectively as the rotatable assemblies 234), and bridge assembly 236. Some implementations may include more or fewer of the rotatable assemblies depending, for example, on the size of the internal adjustable firmness structure 230 and the size of the rotatable assemblies 234.

In some implementations, the rotatable assemblies 234 are structures made from compressible materials that are configured to be rotated to alter which portions of the rotatable assemblies face upwards (toward the top of the internal adjustable firmness structure 230). In this example, the rotatable assemblies 234 have a cylindrical shape. Each of the rotatable assemblies 234 may be configured to rotate about its own central axis. In some implementations of the internal adjustable firmness structure 230, the rotatable assemblies 234 are arranged such that the central axes are parallel with each other and oriented along the widthwise (W) dimension of the support assembly 232.

Properties of the compressible materials may vary such that the firmness of the internal adjustable firmness structure 230 varies based on the orientations of the rotatable assemblies 234. For example, a first portion of the rotatable assemblies 234 may have a first ILD and a second portion of the rotatable assemblies 234 may have a second ILD. Depending on the portions of the rotatable assemblies 234 that are oriented towards the top side of the mattress, the firmness of the mattress will vary. The rotatable assemblies 234 of FIG. 3A are rotated by 90 degrees with respect to FIG. 3B.

Figure 4:
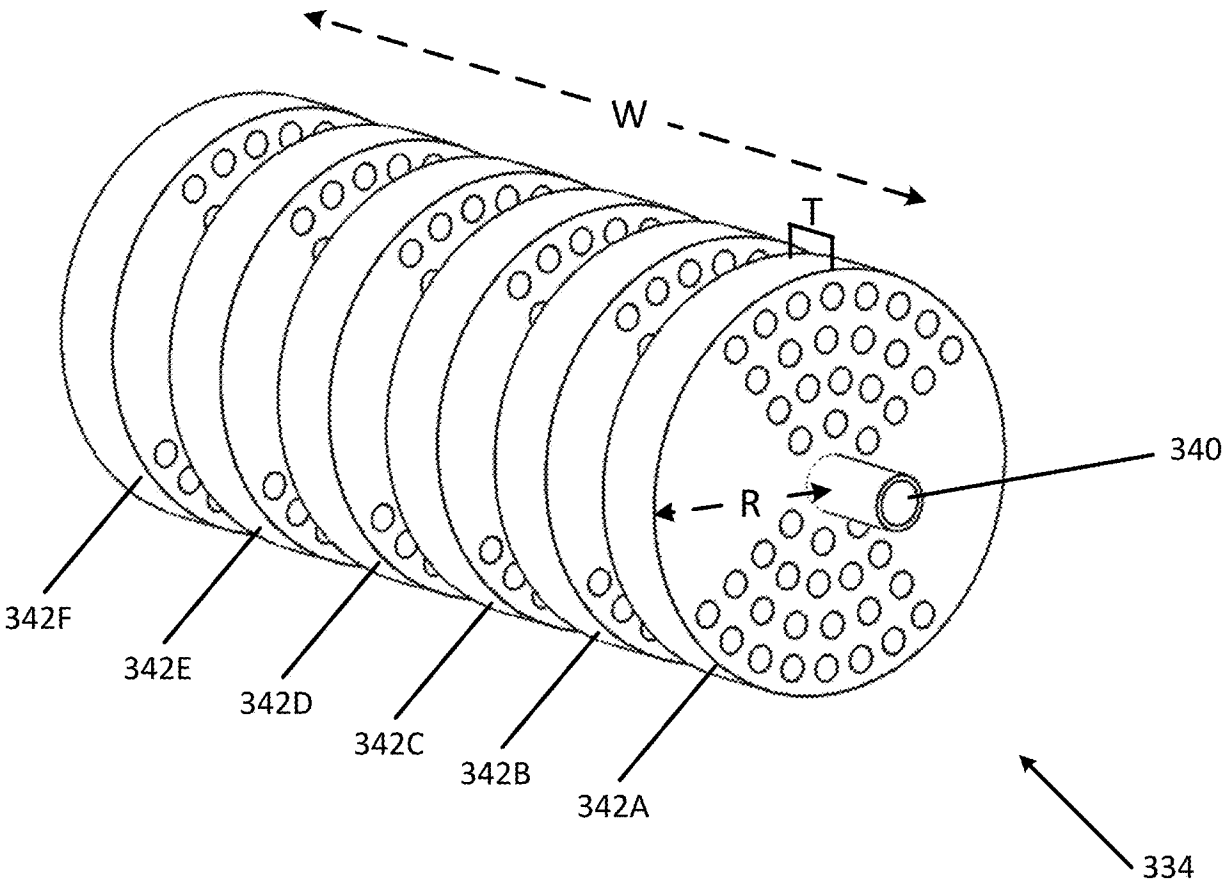
FIGS. 4 AND 4A are schematic diagrams of example rotatable assemblies according to embodiments described herein.

FIG. 4 is a schematic diagram of an example rotatable assembly 334. The rotatable assembly 334 is an example of the rotatable assemblies 234. The rotatable assembly 334 includes an axle 340 and compressible elements 342A, 342B, 342C, 342D, 342E, and 342F (referred to collectively as compressible elements 342). In this example, the axle 340 is an elongate cylindrical structure with a long axis oriented widthwise (W).

The compressible elements 342 have an orientation-specific firmness. For example, the firmness (with respect to an object placed on top of the compressible elements 342) of the compressible elements 342 may change based on the orientation of the compressible elements 342. For example, the compressible elements 342 may be formed from multiple materials that have different compression properties. Additionally or alternatively, the compressible elements 342 may be formed from a single material that includes one or more cutouts that alter the compression properties of the compressible elements 342. Examples of compressible elements having an orientation-specific firmness are illustrated and discussed with respect to at least FIGS. 9-11.

The compressible elements 342 share a central axis that is aligned with the long axis of the axle 340. The compressible elements 342 are coupled to the axle 340 such that the axle 340 passes through the centers of the compressible elements 342. The axle 340 is coupled to the compressible elements 342 such that if the axle 340 is rotated, the compressible elements 342 will also be rotated. In this manner, rotating the axle 340 will cause the compressible elements 342 to rotate and will, in turn, alter their firmness.

In this example, the compressible elements 342 are cylindrical structures made of a compressible material. Cylindrical compressible elements may also be referred to as compressible disks. The compressible elements 342 can be described in terms of a thickness (T) and a radius (R). The radius of the compressible elements 342 refers to the distance from the centers of the compressible elements 342 to their edges. Although the term radius is used herein, it should be understood that the compressible elements 342 are not circular in some embodiments. The thickness of the compressible elements 342 refers to the length of the compressible elements 342 along their central axes (i.e., in the widthwise (W) dimension). In this example, the compressible elements 342 are spaced apart from each other along the axle 340 by a distance equal to (or approximately equal to) the thickness of the compressible elements 342. This spacing allows the compressible elements of two adjacent rotatable assemblies to be interleaved, which is illustrated and described further with respect to at least FIGS. 5A and 5B.

In some implementations, the spacing between the compressible elements 342 is slightly larger than the thickness of the compressible elements 342 to allow a small gap between interleaved disks to reduce or eliminate friction between surfaces of the compressible elements. In some implementations, a thin layer of low-friction material may be coupled to the surfaces of the compressible elements 342 to reduce friction between the compressible elements 342 and adjacent compressible elements, the support assembly, or the bridge assembly. The low-friction material may be a sheet of polyethene, polytetrafluoroethylene, or flashspun high-density polyethylene fibers. In some implementations, the compressible elements may be enclosed or partially enclosed in an enclosure formed from a low-friction fabric formed from one or more of nylon, elastane, polyester, silk or artificial silk, viscose fabric or films such as rayon, or combinations thereof. In some implementations, the compressible elements may be dipped or otherwise coated with a low-friction compound. In some implementations, the axle may include air holes to allow passage of air in and out of the compressible elements if the coating is airtight. The compressible elements may also pass through a reservoir of a wet or dry lubricating material.

In some implementations, the axle 340 is formed from materials having properties that allow the axle 340 to be torqueable. As used herein, the axle 340 is torqueable if a rotational force around the long axis applied to an end of the axle 340 causes the axle 340 (and the coupled compressible elements 342) to rotate by substantially the same magnitude along the length of the axis. In other words, the axle 340 is formed from materials that substantially resist deformation when a rotational force is applied to an end of the axle 340. The axle 340 may be formed from a rigid material such as a rigid plastic (e.g., polyvinyl chloride (PVC)), wood, metal, or combinations thereof. Beneficially, the torqueable axle will cause the entire axle and the compressible elements 342 attached thereto to rotate substantially similarly, allowing control of the orientation of the compressible elements 342.

Figure 4A:
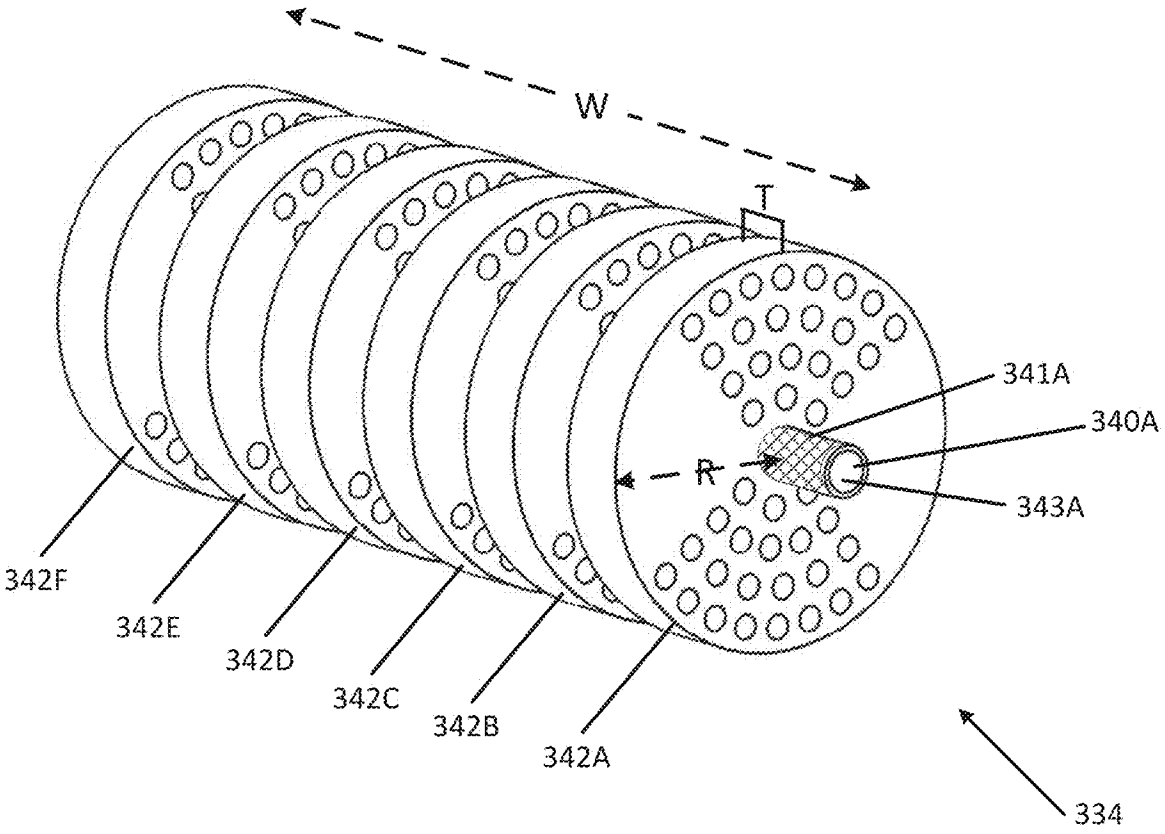

In some embodiments, the axle 340 is both torqueable and compressible. As used herein, the axle 340 is compressible if it resiliently compresses under a load applied orthogonal to its long axis. In some implementations, the axle 340 is formed from a rigid foam material. FIG. 4A includes an axle 340A, which is an example of the axle 340 and includes a braided metal sleeve 341A, which may be coated with plastic or another coating material. The braided metal sleeve 341A may be hollow or may enclose an axle 343A formed from another material such as a foam.

Figure 5B:
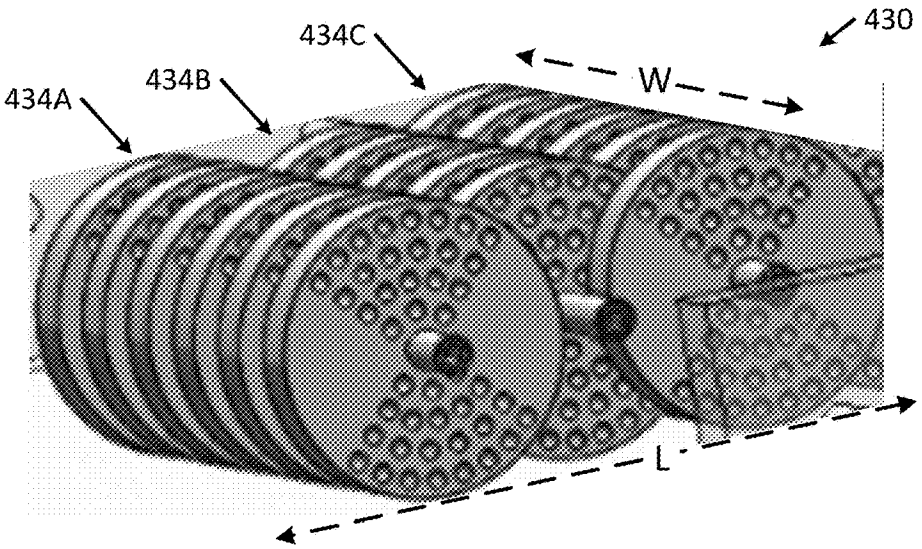
FIGS. 5A and 5B are schematic diagrams of a portion of an example internal adjustable firmness structure according to embodiments described herein.
Figure 5A:
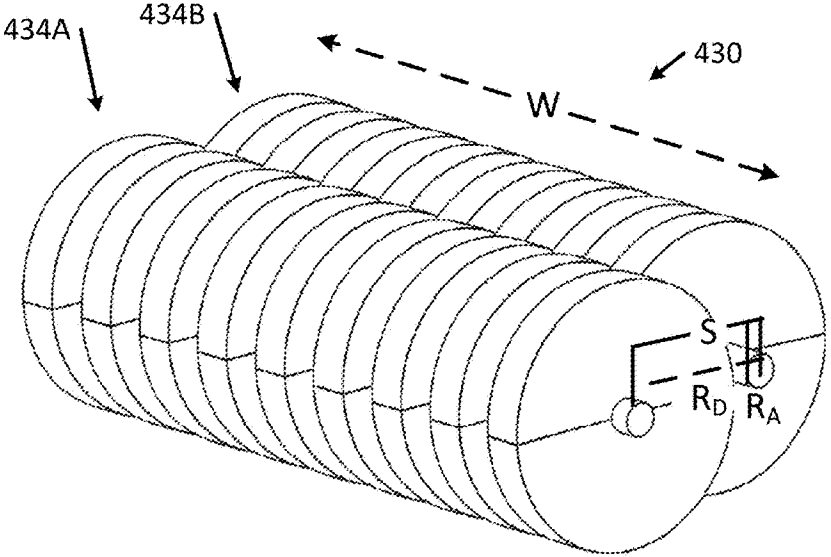

FIGS. 5A and 5B are schematic diagrams of a portion of an example internal adjustable firmness structure 430. The internal adjustable firmness structure 430 may be similar to the previously described internal adjustable firmness structure 230.

As shown in FIG. 5A, the portion of the internal adjustable firmness structure 430 includes rotatable assemblies 434A and 434B. As shown in FIG. 5B, the portion of the internal adjustable firmness structure 430 includes rotatable assemblies 434A, 434B, and 434C. The rotatable assemblies 434A, 434B, and 434C may be similar to the rotatable assembly 334. The internal adjustable firmness structure 430 may include additional rotatable assemblies that are not shown in FIGS. 5A and 5B.

Each of the rotatable assemblies 434A, 434B, and 434C include compressible elements aligned along an axle of the rotatable assemblies. The compressible elements and axle are illustrated and described further with respect to at least FIG. 4. The long axes of the axles of the rotatable assemblies 434A, 434B, and 434C are parallel to each other and spaced apart along the length of the internal adjustable firmness structure 430. For example, the rotatable assemblies 434 may be separated in the lengthwise (L) direction by a space (S) that is approximately equal to the sum of the radius of compressible element (or compressible disk in this example) (RD) and the radius of the axle (RA).

In some implementations, this spacing is maintained by a rigid linkage, such as a thin plastic linkage structure, that spans between two adjacent rotatable assemblies and wraps at least partially around the axles. In some implementations, the spacing may be maintained by one or more cords that includes loops that fit over adjacent axles. The cords may prevent or limit the expansion of the spacing between the axles. An example linkage is illustrated and described further with respect to at least FIG. 17.

As can be seen, the compressible elements of the rotatable assembly 434A are offset with respect to the compressible elements of the rotatable assembly 434B along the long axis of the axle by approximately the thickness of one compressible disk. This offset allows the compressible elements of the rotatable assembly 434A to be interleaved with the compressible elements of the rotatable assembly 434B. Similarly, the compressible elements of the rotatable assembly 434C are offset with respect to the compressible elements of the rotatable assembly 434B along the long axis of the axle by approximately the thickness of one compressible disk. This offset allows the compressible elements of the rotatable assembly 434B to be interleaved with the compressible elements of the rotatable assembly 434C.

Referring back now to FIGS. 3A and 3B, the support assembly 232 is a structure that is configured to support the rotatable assemblies 234. In this example, the support assembly 232 includes support wedges 233A, 233B, 233C, 233D, and 233E (referred to collectively as support wedges 233). Although the support wedges 233 are shown as separate components in this figure, in some embodiments, some or all of the support wedges are joined as a monolithic structure. For example, the support assembly 232 may also include a flat layer of foam that is joined to each of the support wedges.

The support wedges 233 may be formed from a relatively rigid compressible foam. For example, as compared to the rotatable assemblies 234 and the bridge assembly 236, the support wedges 233 may be formed from a material having a higher ILD (i.e., a material that deflects/compresses less under the same force).

Figure 6B:
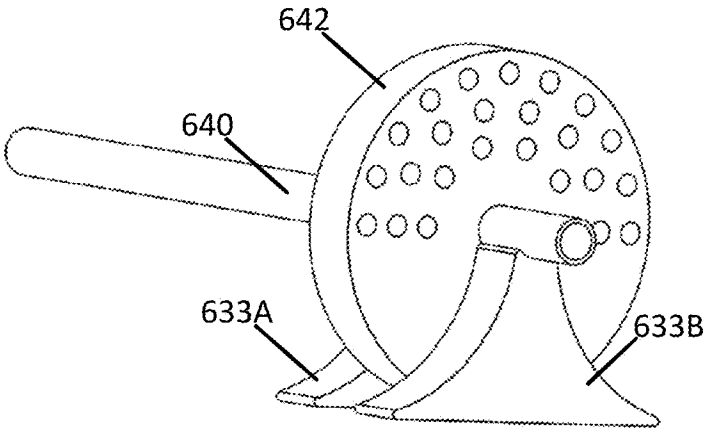
FIG. 6B is a schematic drawing that illustrates a compressible element disposed on an axle that is being supported by support wedges according to embodiments described herein.
Figure 6A:
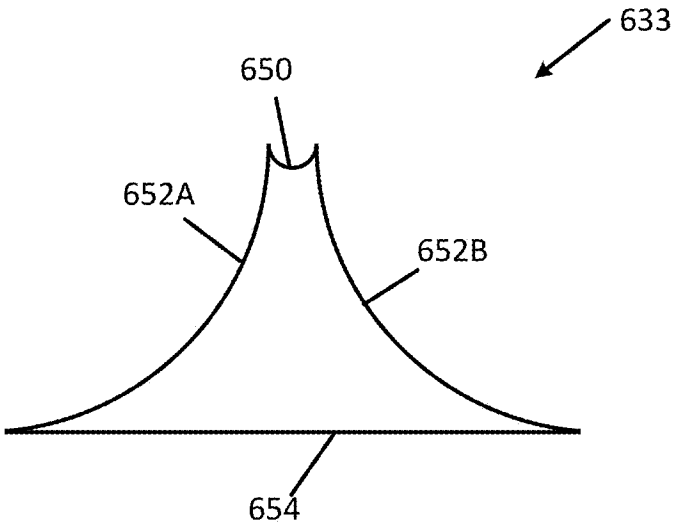
FIG. 6A is a schematic drawing of an example support wedge according to embodiments described herein.

FIG. 6A is a schematic drawing of an example support wedge 633. The support wedge 633 is an example of the support wedges 233. The support wedge 633 includes axle support region 650, compressible element support regions 652A and 652B, and bottom surface 654. The axle support region 650 is configured to contact and support an axle of a rotatable assembly. By supporting the axle, the support wedge 633 reduces the amount of force that is transferred from a top portion of the compressible element to a bottom portion of the compressible element. In this manner, the material properties (e.g., the ILD) of the bottom portion of the compressible element have less impact on the overall firmness than the material properties of the top portion.

The compressible element support regions 652A and 652B are configured to contact and support the bottom portions of compressible elements of rotatable assemblies that are adjacent to the rotatable element being supported by the axle support region 650. The shapes of the compressible element support regions 652A and 652B are negatives (or inverses) of the shape of a side of the bottom portion of a compressible element. In this example, the compressible element would be disk shaped and accordingly, the compressible element support regions 652A and 652B have an arch-shape corresponding to a quarter of a circle.

FIG. 6B is a schematic drawing that illustrates a compressible element 642 disposed on an axle 640 that is being supported by support wedges 633A and 633B. The axle 640 may be similar to the previously described axle 340 and the compressible element 642 may be similar to the previously described compressible elements 342.

Forces that are applied to the top of the compressible element 642 will primarily either cause a compression of the top portion of the compressible element 642 (i.e., the portion of the compressible element 642 above the axle 640) or be transferred to the axle 640. The portion of the force transferred to the axle 640 will result in compression of the support wedges 633A and 633B. Depending on the amount of force transferred to the support wedges 633A and 633B and the consequent amount of compression experienced by the support wedges 633A and 633B, a portion of the force may also result in some compression of the bottom portion of the compressible element 642 (i.e., the portion below the axle 640). In at least some embodiments, because the support wedges 633A and 633B are more rigid material than the compressible element 642, a minority of the force transferred to the axle 640 results in compression of the bottom portion of the compressible element.

In some implementations, the support wedges are formed from a material that is no more rigid than the materials in the compressible elements. In some implementations, the support wedges are formed from a material that has similar compressibility as the most compressible material in the compressible elements. In these implementations, the support wedges may not divert force from the lower portions of the compressible elements. This arrangement may be beneficial when opposites sides of the compressible elements have similar properties (e.g., when the compressible element is formed with quadrants having different properties as discussed with respect to at least FIGS. 111 and 11J). Beneficially, in at least some of these embodiments, the axles of the rotatable assemblies are allowed to move and sink into the support assembly, reducing the likelihood that a reclining individual will feel the axles.

Referring back now to FIGS. 3A and 3B, the bridge assembly 236 is a structure that is configured to fit over the rotatable assemblies 234. and conform to the shape of the rotatable assemblies 234. The bridge assembly 236 may, for example, fill in the top surface of the rotatable assemblies 234 so as to form a substantially flat surface. In this example, the bridge assembly 236 includes bridge wedges 237A, 237B, 237C, 237D, and 237E (referred to collectively as bridge wedges 237). Although the bridge wedges 237 are shown as separate components in this figure, in some embodiments, some or all of the bridge wedges are joined as a monolithic structure. For example, the bridge assembly 236 may also include a flat layer of foam that is joined to each of the bridge wedges. In some implementations, the bridge assembly may be formed from a foam material that is more compressible (i.e., having a lower ILD) than the support assembly or the compressible element.

Figure 7A:
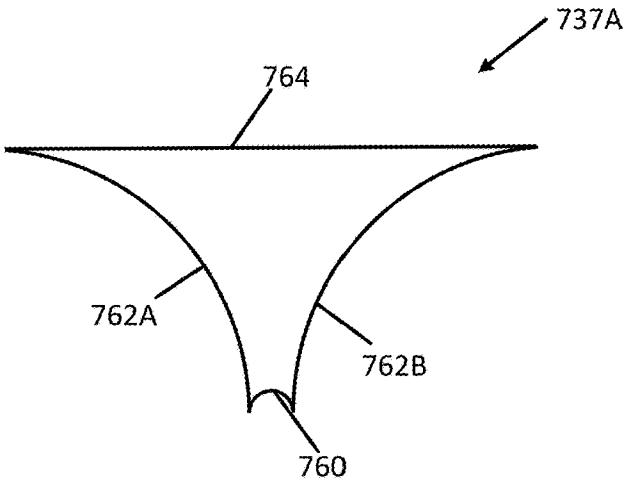
FIG. 7A is a schematic drawing of an example bridge wedge according to embodiments described herein.

FIG. 7A is a schematic drawing of an example bridge wedge 737A. The bridge wedge 737A is an example of the bridge wedges 237. The bridge wedge 737A includes axle contact region 760, compressible element contact regions 762A and 762B, and top surface 764. The top surface 764 is a flat surface. In some embodiments, the top surface 764 is configured to contact the bottom side of the transition layer 104 or the comfort layer 102.

The axle contact region 760 is configured to contact an axle of a rotatable assembly, and the compressible element contact regions 762A and 762B are configured to contact an upper surface of adjacent compressible elements. As force is applied to the top surface 764 that force, in part, compresses the bridge wedge 737A and, in part, is transferred to the axle and the adjacent compressible elements via the axle contact region 760 and the compressible element contact regions 762A and 762B, respectively. In some implementations, because the compressible element contact regions 762A and 762B are larger than the axle contact region 760, a majority of the transferred force is transferred to the adjacent compressible elements rather than to the axle. For example, the force may be transferred to the top portions of the adjacent compressible elements. Beneficially, this transfer of force to the compressible elements may allow the material properties (e.g., the ILD) of the top portions of the adjacent compressible elements to have a greater effect on the overall firmness of the adjustable firmness support layer than the axle.

Figure 7B:
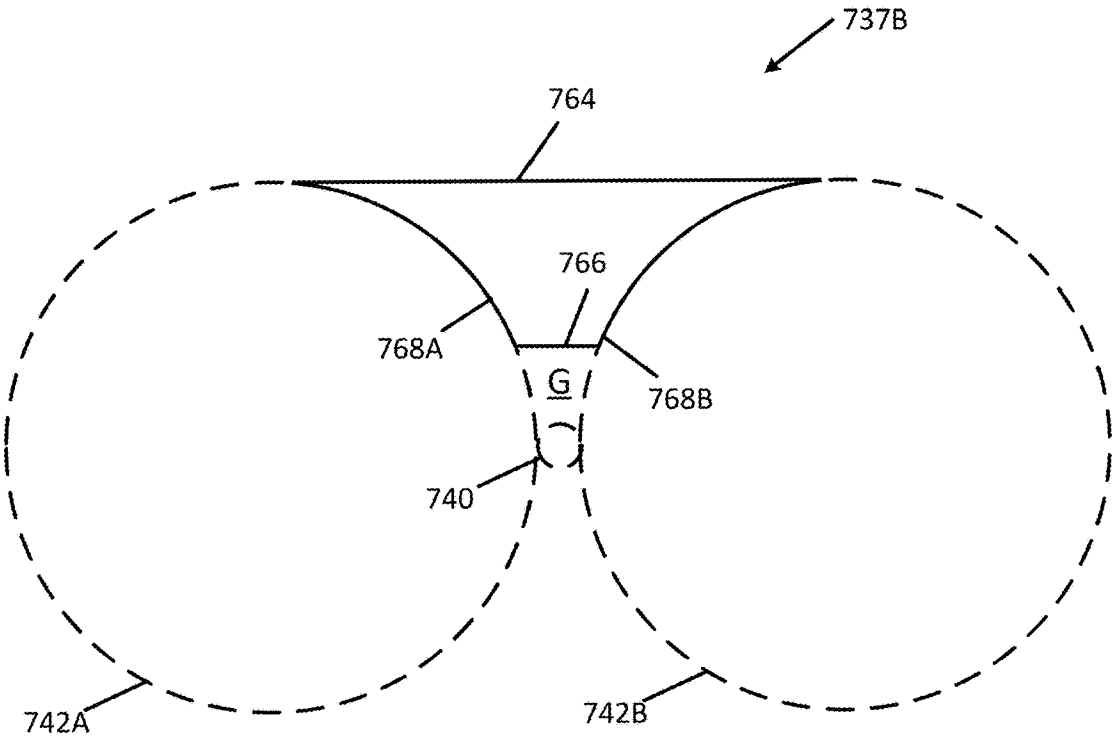
FIG. 7B is a schematic drawing of an example bridge wedge according to embodiments described herein.

FIG. 7B is a schematic drawing of an example bridge wedge 737B. Also shown are an axle 740 and compressible elements 742A and 742B. The axle 740 may be similar to the previously described axle 340 and the compressible elements 742A and 742B may be similar to the previously described compressible elements 342.

The bridge wedge 737B is an example of the bridge wedges 237. The bridge wedge 737B includes a bottom surface 766, compressible element contact regions 768A and 768B, and the top surface 764. The bridge wedge 737B may be similar to the bridge wedge 737A except that the bridge wedge 737B is not configured to contact the axle 740. Instead, the bridge wedge 737B includes a bottom surface 766 that is substantially flat. The bridge wedge 737B is configured to be supported by the compressible elements 742A and 742B via the compressible element contact regions 768A and 768B, so as to provide a gap (G) between the bottom surface 766 and the axle 740. The compressible element contact regions 768A and 768B may be similar to the compressible element contact regions 762A and 762B except that the compressible element contact regions 768A and 768B do not extend as far toward the axle 740.

The gap provided by the bridge wedge 737B may cause more of any force applied to the top surface 764 to be transferred to the adjacent compressible elements 742A and 742B than to the axle 740. In fact, until the compressible elements 742A and 742B have compressed by an amount sufficient to close the gap between the bottom surface 766 and the axle 740, no force will be transferred to the axle 740 by the bridge wedge 737B.

Figure 8:
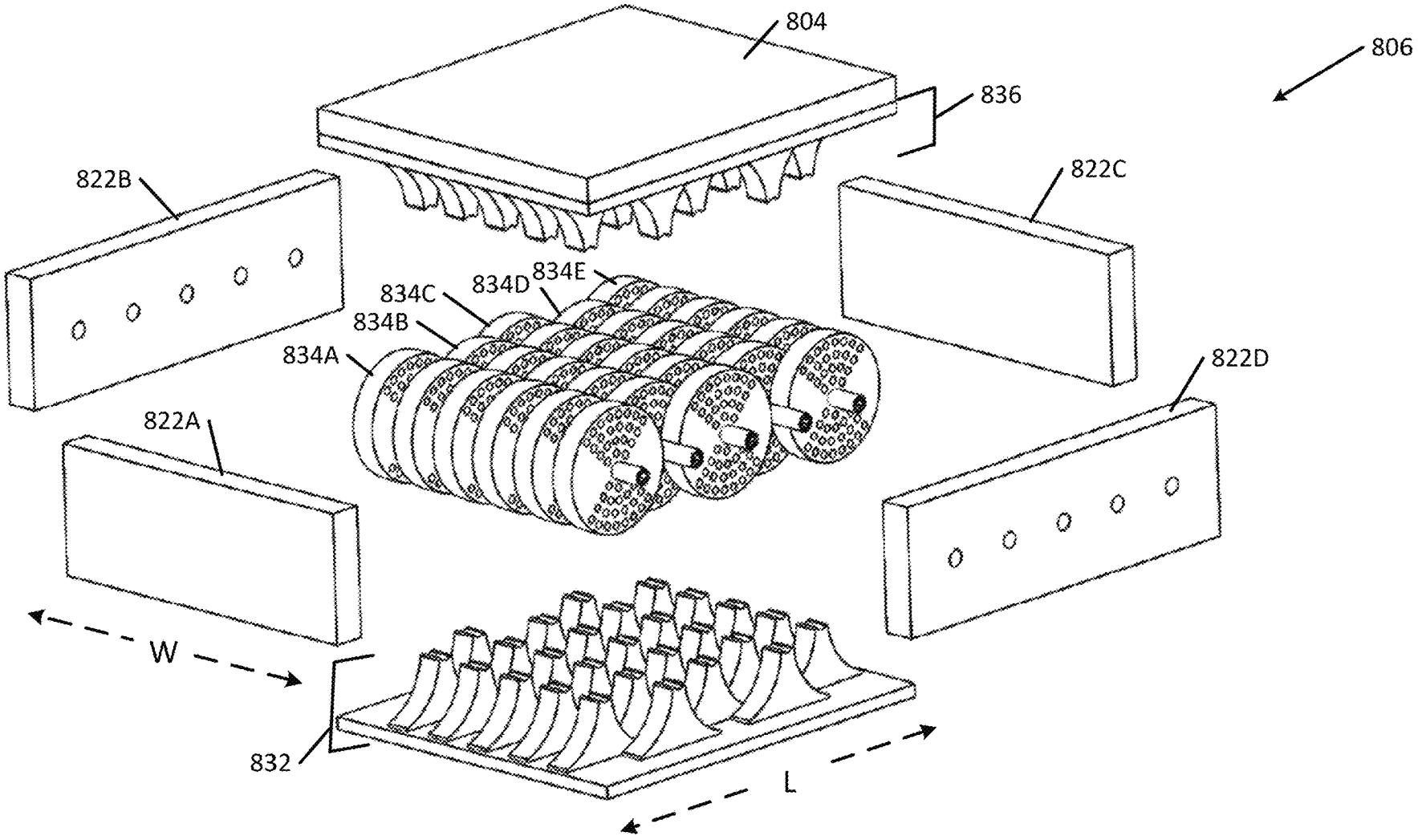
FIG. 8 is a schematic diagram of an exploded view of a portion of an example adjustable firmness layer according to embodiments described herein.

FIG. 8 is a schematic diagram of an exploded view of a portion of an example adjustable firmness layer 806. Also shown is an example transition layer 804. The adjustable firmness layer 806 is an example of the adjustable firmness layer 106 and the transition layer 804 is an example of the transition layer 104.

In this figure, the adjustable firmness layer 106 includes a support assembly 832, a bridge assembly 836, rotatable assemblies 834A, 834B, 834C, 834D, and 834E (referred to collectively as the rotatable assemblies 834), and side panels 822A, 822B, 822C, and 822D.

The rotatable assemblies 834 may be similar to the previously described rotatable assemblies 434. Each of the rotatable assemblies 834 includes multiple compressible elements. The compressible elements of adjacent rotatable elements are offset from and interleaved with each other.

As can be seen, the support assembly 832 is a monolithic unit that includes multiple support wedges arranged in offset rows that are interleaved to support the axles of the rotatable assemblies 834 between the compressible elements. Similarly, the bridge assembly 836 includes multiple bridge wedges arranged in offset rows that are interleaved to fit against the compressible elements of the rotatable assemblies 834.

The side panels 822A, 822B, 822C, and 822D may be similar to the previously described side panels 222A, 222B, 222C, and 222D, respectively. In this example, the side panels 822B and 822D and include apertures through which the axles of the rotatable assemblies 834 may pass. The apertures allow access through the side panels to the axles so that the rotatable assemblies may be rotated by applying a rotational force to the axles. Examples of the side panels and apertures are further described and illustrated with respect to at least FIGS. 12-15.

In some implementations, the axles of the rotatable assemblies are formed from two separate rods that are pivotably coupled at a midpoint widthwise, allowing each side of the axle to rotate about its long axis independently so as to allow independent adjustment of the firmness of each side of the rotatable assemblies (e.g., to accommodate two people with different firmness preferences).

In some implementations, the bridge assembly may include one or more of a gel layer or a microbead layer. These layers may fill gaps between the rotatable assemblies 834 to reduce any feeling of lumpiness that may be caused by the shapes of the rotatable assemblies 834.

Figure 9:
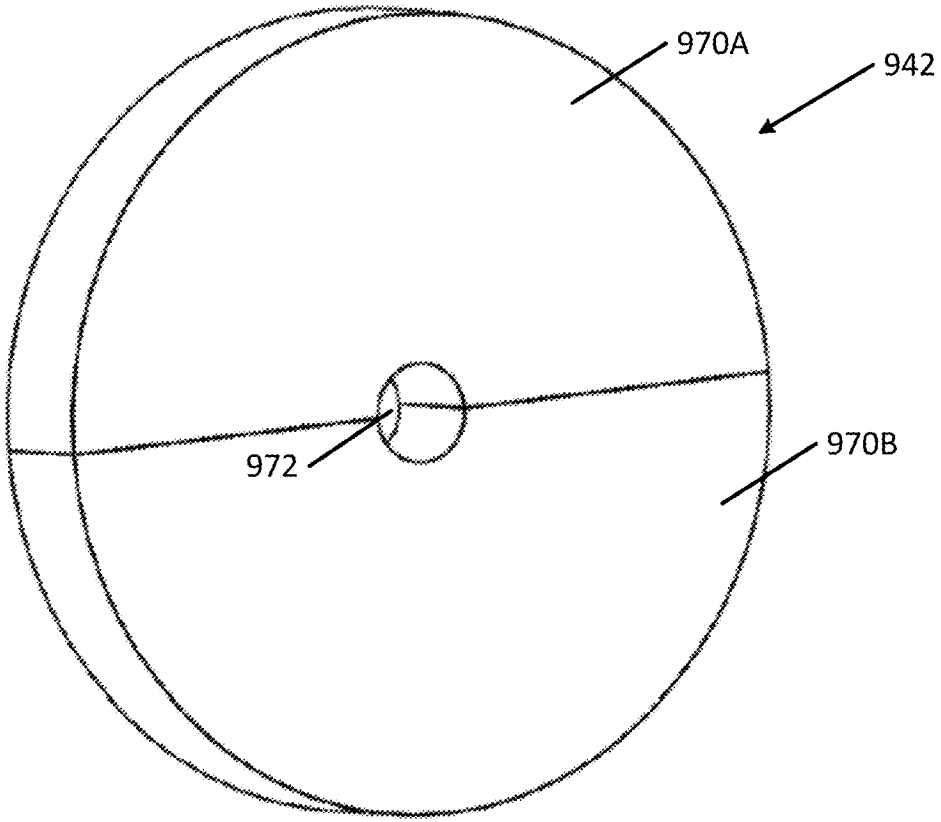
FIG. 9 is a schematic diagram of an example compressible element according to embodiments described herein.

FIG. 9 is a schematic diagram of an example compressible element 942. The compressible element 942 is an example of the compressible elements 342. The compressible element 942 may be a component of a rotatable assembly.

In this example, the compressible element 942 has a cylindrical shape with a first portion 970A and a second portion 970B. The first portion 970A may have different material properties than the second portion 970B. For example, the first portion 970A may be formed from a foam having a higher ILD than a foam that forms the second portion 970B. The difference in ILD of the materials in the first portion 970A and 970B may allow for a different perceived firmness depending on the orientation of the compressible element.

The compressible element 942 also includes a mounting aperture 972 through which an axle of a rotatable assembly may pass and the compressible element 942 may be coupled to the axle. In some implementations, the compressible element 942 is coupled to the axle via adhesive, friction, or a combination thereof.

Figure 10B:
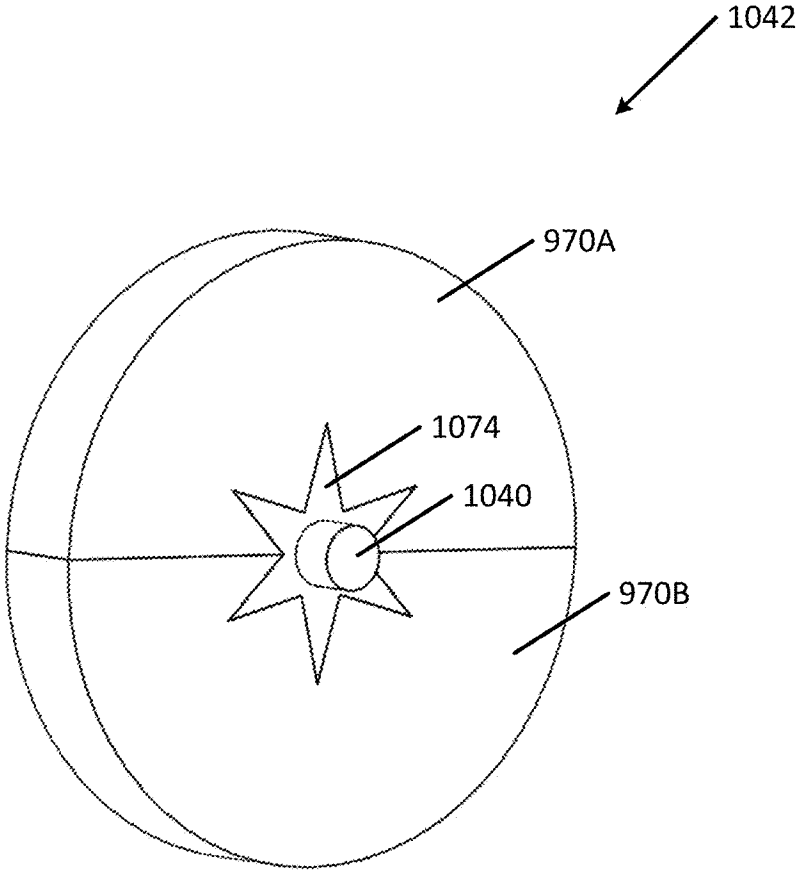
FIGS. 10A and 10B are schematic diagrams of an example compressible element that includes a coupling element.
Figure 10A:
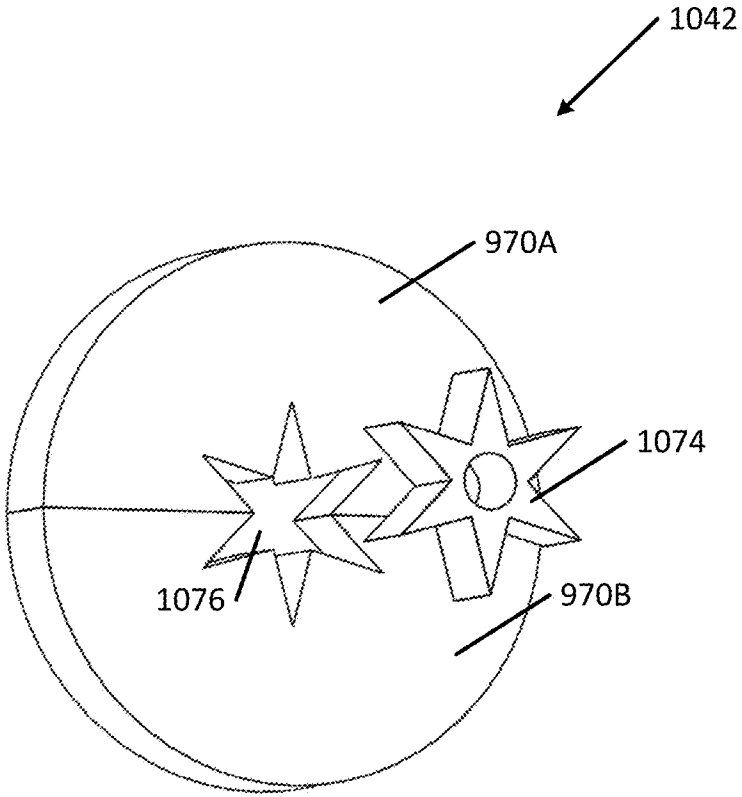

FIGS. 10A and 10B are schematic diagrams of an example compressible element 1042 that includes a coupling element 1074. FIG. 10A is an exploded view of the compressible element 1042 and FIG. 10B is a view of the compressible element 1042 coupled to an axle 1040.

The compressible element 1042 is an example of the compressible elements 342. The compressible element 1042 may be similar to the compressible element 942 except that the compressible element 1042 includes a coupling element 1074 that is configured to couple to an axle 1040. The compressible element 1042 also includes the first portion 970A and the second portion 970B, which have been previously described.

The coupling element 1074 may be star shaped. In this example, the coupling element is shaped like a 6-point star. In other embodiments, the coupling element may have a star shape with more or fewer points. The star shape of the coupling element may fit into an aperture 1076 in the first portion 970A and second portion 970B of the compressible element 1042 that has a corresponding shape. The fit of the star shape into the aperture may serve to couple the coupling element 1074 to the first portion 970A and second portion 970B. Additionally, the surface area of the coupling element 1074 may provide a larger area upon which to apply adhesive to further couple the coupling element 1074 to the first portion 970A and second portion 970B.

In some embodiments, the coupling element 1074 is formed from a more rigid material than the rest of the compressible element 1042. For example, the coupling element 1074 may be formed from a rubber material. The more rigid material of the coupling element 1074 may be more readily coupled to the axle 1040 than the more compressible material of the rest of the compressible element 942. The coupling element 1074 may be coupled to the axle 1040 using one or more of adhesive, friction, or a mechanical fastener, such as a pin or a screw. In some embodiments, the coupling element 1074 may be formed from a material other than rubber, such as wood or foam.

Although the coupling element 1074 may be more rigid than the first portion 970A and the second portion 970B, the coupling element 1074 may also be flexible. For example, when made from rubber, the points of the star shape may remain flexible so as to not be felt by a body reclining on the mattress.

FIGS. 11A-H are schematic diagrams of example compressible elements. Although not shown in each of these figures, each of the illustrated compressible elements may include an aperture and may be combined with a coupling element similar to the previously described coupling element 1074. In these examples, each of the compressible elements have a cylindrical shape. As these compressible elements are rotated, different portions of the underlying materials are oriented upward altering the firmness of the corresponding region of a mattress.

FIG. 11A illustrates a compressible element 1142A that has a first portion having a crescent shape and a second portion corresponding to the remainder of the cylinder. The first portion and the second portion may be formed from different materials that have different properties, such as foams that have different ILD values.

FIG. 11B illustrates a compressible element 1142B that has a first portion having a tear-drop shape and a second portion having an opposite tear-drop shape. Together, the first portion and the second portion form a circle and the interface between the first portion and the second portion forms a curve like that dividing the yin-yang symbol. The first portion and the second portion may be formed from different materials that have different properties, such as foams that have different ILD values.

FIG. 11C illustrates a compressible element 1142C that has a first portion having a circle shape and extending from a point on the edge toward the center of the compressible element 1142C. The compressible element 1142C also has a second portion having a circle shape and extending from an opposite point on the edge toward the center of the compressible element 1142C. In some implementations, the first and second portions extend to the center of the compressible element. The compressible element 1142C also includes a third portion and fourth portion. The third and fourth portions correspond to the remainders of the cylindrical region. In some implementations, the first portion, the second portion, the third portion, and the fourth portion are each formed from different materials that have different properties, such as foams that have different ILD values. In some implementations, the third and fourth portions are formed from the same material. In implementations in which the first and second portions do not extend to the center of the compressible element 1142C, the third and fourth portions may be a single monolithic portion.

FIG. 11D illustrates a compressible element 1142D that has been divided into a plurality of approximately equal triangle-like slices of the cylinder. In this example, the compressible element 1142D includes seven equal-sized (or approximately equal sized) portions. In some implementations, more or fewer portions are included. In this example, the portions have an approximately triangular shape with slightly curved edges. In some implementations, the portions are each formed from different materials that have different properties, such as foams that have different ILD values.

FIG. 11E illustrates a compressible element 1142E that has been divided into three portions by straight parallel lines. In some implementations, the portions are each formed from different materials that have different properties, such as foams that have different ILD values. For example, the middle portion may be formed of a more rigid foam than the outside portions so as to better facilitate transfer of force to an axle running through the middle portion. The firmness of the corresponding portion of the mattress may then be based on the properties of the outside portion of the compressible element 1142E that is facing up.

FIG. 11F illustrates a compressible element 1142F that has a first portion having a heart shape and a second portion corresponding to the remainder of the cylinder. The first portion and the second portion may be formed from different materials that have different properties, such as foams that have different ILD values.

FIG. 11G illustrates a compressible element 1142G that has a first portion and second portion that are separated by a curved, spikey border. The border may allow a smoother change in overall firmness as the orientation of the compressible element 1142G is rotated. The first portion and the second portion may be formed from different materials that have different properties, such as foams that have different ILD values.

FIG. 11H illustrates a compressible element 1142H that has a first portion and second portion. The first portion is ring-shaped and surrounds the outside edge of the compressible element 1142H. The second portion is elliptical shaped and positioned within the first portion. In some implementations, the space between the first portion and the second portion is left empty. The first portion and the second portion may be formed from different materials that have different properties, such as foams that have different ILD values. In some implementations, the first portion and the second portion are formed from the same material.

In some implementations, the space between the first portion and the second portion may be filled with a third portion and a fourth portion. Each of the first portion, second portion, third portion, and fourth portion may be formed from different materials. In some implementations, the first portion and the second portion are formed from a first material and the third portion and the fourth portion are formed from a second material. The first material may have a higher ILD than the second material.

FIGS. 11I-11N illustrate compressible elements that have regions with apertures to allow for additional or different compression properties. In FIGS. 11I and 11*l*, the compressible elements 11421 and 1142J are divided into quadrants. The quadrants may correspond to partial circles, each having an arc length of 90 degrees. In this example, two of the quadrants include a grid of apertures, the other quadrants do not include apertures. Here, a quadrant will have different compressibility properties than the other adjacent quadrants but similar properties to the opposite quadrant.

In some implementations, this arrangement of quadrants may allow for different compressibility based on which quadrant is oriented upward. For example, if a quadrant with apertures is oriented upward, a compression force applied to the top of the compressible elements will compress the apertures allowing for more overall compression of the compressible element than when a quadrant without apertures is oriented upward. Other implementations may also include quadrants with other patterns of apertures or materials that cause adjacent. For example, a quadrant may be formed using two different materials that have different compression properties such that each quadrant is made from the same material as the opposite quadrant and a different material than the adjacent quadrants.

In some implementations, the support assembly (which is further described in at least FIGS. 3, 6A & 6B) is formed from a material that is similar in compressibility to the more compressible quadrants. This arrangement may allow both the upward and downward facing quadrants to compress under load. In some implementations, compressible elements with opposite pairs of quadrants having substantially the same compressibility are formed using two different types of material, such as two types of foam with different ILD values.

In FIGS. 11K-M, the compressible elements 1142K, 1142L, and 1142M are shown with various horn-shaped regions of apertures. The horn-shaped regions may allow for smooth (gradual) transitions in changes of compressibility as the compressible elements' orientations change. FIG. 11N includes a compressible element 1142N that includes a grid of apertures on one half (semi-circle) and no apertures on the other half (semi-circle). The compressible element 1142N may function in a manner similar to the compressible element 942 in which two separate types of material were used on each half.

In some implementations, the compressible elements are formed using a rapid fabrication technology, such as 3D printing. For example, a compressible element may be formed with a mesh-like pattern having various regions with different densities. The mesh-like pattern may include meso-structured cellular patterns. In some implementations, the compressible element may be treated after fabrication with a compound to reduce surface imperfections and reduce friction. For example, the compressible element may be treated using an acetone bath to reduce friction.

In some implementations, the compressible elements may be formed from filled bladders, such as rubber bladders filled with one or more fluids (e.g., liquids or gasses). The bladders may be permanently sealed such that they are not adjustable. The bladders may, for example, have any of the shapes described in FIGS. 11I-N.

Figure 12:
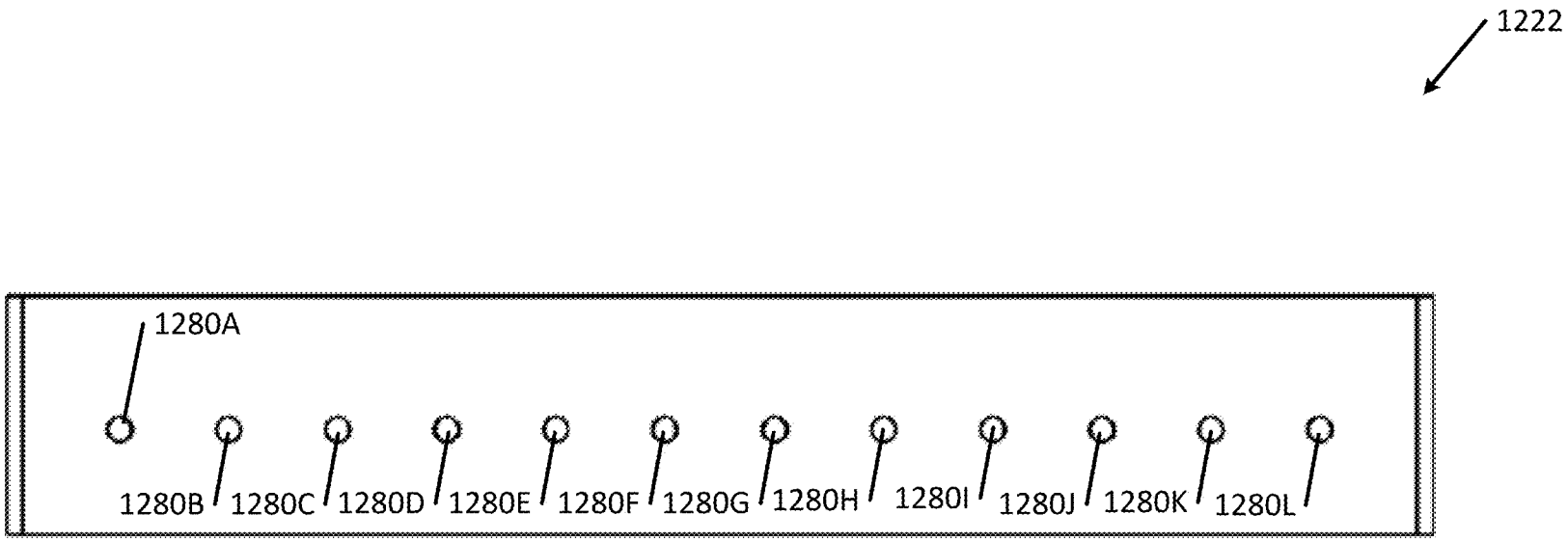
FIG. 12 is a schematic diagram of an example side panel according to embodiments described herein.

FIG. 12 is a schematic diagram of an example side panel 1222. The side panel 1222 is an example of the side panels 222B and 222D. The side panel 1222 may be formed from a foam material. The side panel 1222 includes apertures 1280A, 1280B, 1280C, 1280D, 1280E, 1280F, 1280G, 1280H, 1280I, 1280J, 1280K, and 1280L (referred to collectively as apertures 1280). Some implementations include more or fewer apertures.

The apertures 1280 permit axles of rotatable assemblies to pass through the side panel 1222. These axles may then be rotated to adjust the firmness of the rotatable assemblies. In some implementations, the apertures 1280 allow adjustment of the rotation of the rotatable assemblies without removing the side panel 1222.

As noted previously, the entire adjustable firmness mattress 100 may be enclosed in a fabric cover. The fabric cover may include an opening through which the apertures 1280 may be accessed. The opening may include buttons, snaps, a zipper, or another means for securing the opening in a closed position.

Figure 13:
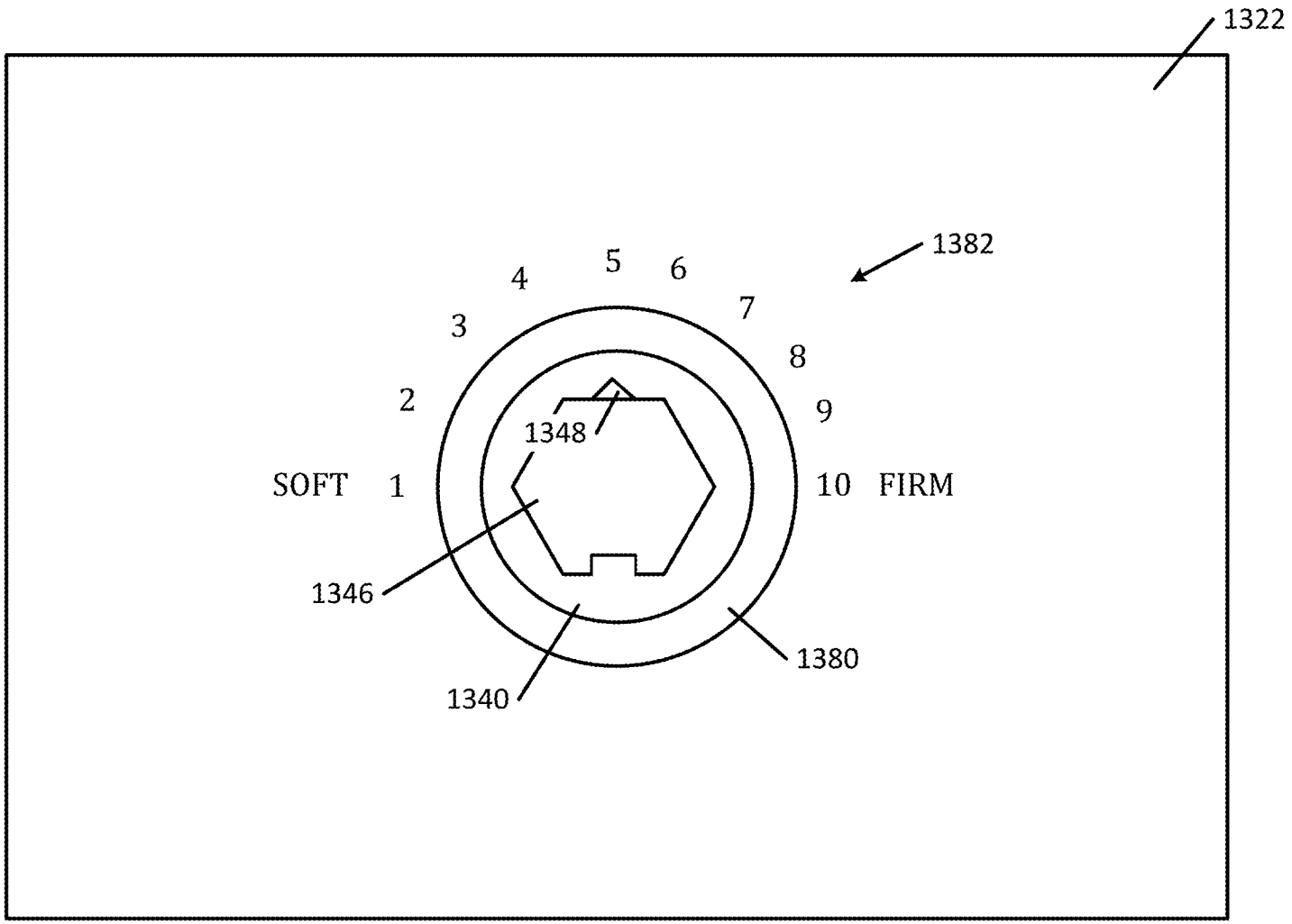
FIG. 13 is a schematic diagram of a portion of an example side panel with an example axle according to embodiments described herein.

FIG. 13 is a schematic diagram of a portion of an example side panel 1322 with an example axle 1340. The side panel 1322 is an example of the side panels 222B and 222D. The side panel 1322 may be similar to the side panel 1222. The side panel 1322 includes an aperture 1380.

In this figure, an end of an axle 1340 is passing through the aperture 1380. The end of the axle 1340 includes a keyed receiver 1346. The keyed receiver 1346 is configured to receive an adjustment tool, such as a wrench, with a corresponding insert. The adjustment tool can then be used to rotate the axle 1340 (and the corresponding rotatable assembly). In this example, the keyed receiver 1346 has a hexagonal shape with a notch. The notch in the keyed receiver limits the orientation of the adjustment tool when it is inserted into the keyed receiver 1346. The indicator 1348 points to a portion of a marker 1382 of the side panel 1322 that corresponds to the current firmness level of the rotatable assembly associated with the axle 1340. In some implementations, the keyed receiver 1346 causes a handle of the adjustment tool to point in the same direction as the indicator 1348 so as to serve as a proxy for the indicator while adjustments are being made. In this example, the marker 1382 represents different firmness levels with numeric scores. In some implementations, the marker 1382 may include different indicators of firmness levels, such as colors.

In some implementations, the keyed receiver 1346 is coupled to the axle 1340 with a torque limiter. The torque limiter may limit the amount of torque transmitted from the keyed receiver 1346 to the axle 1340. Beneficially, the torque limiter may prevent delivering a rotational force that exceeds the bond strength between the axle and the compressible elements, potentially damaging a rotatable assembly.

Figure 14:
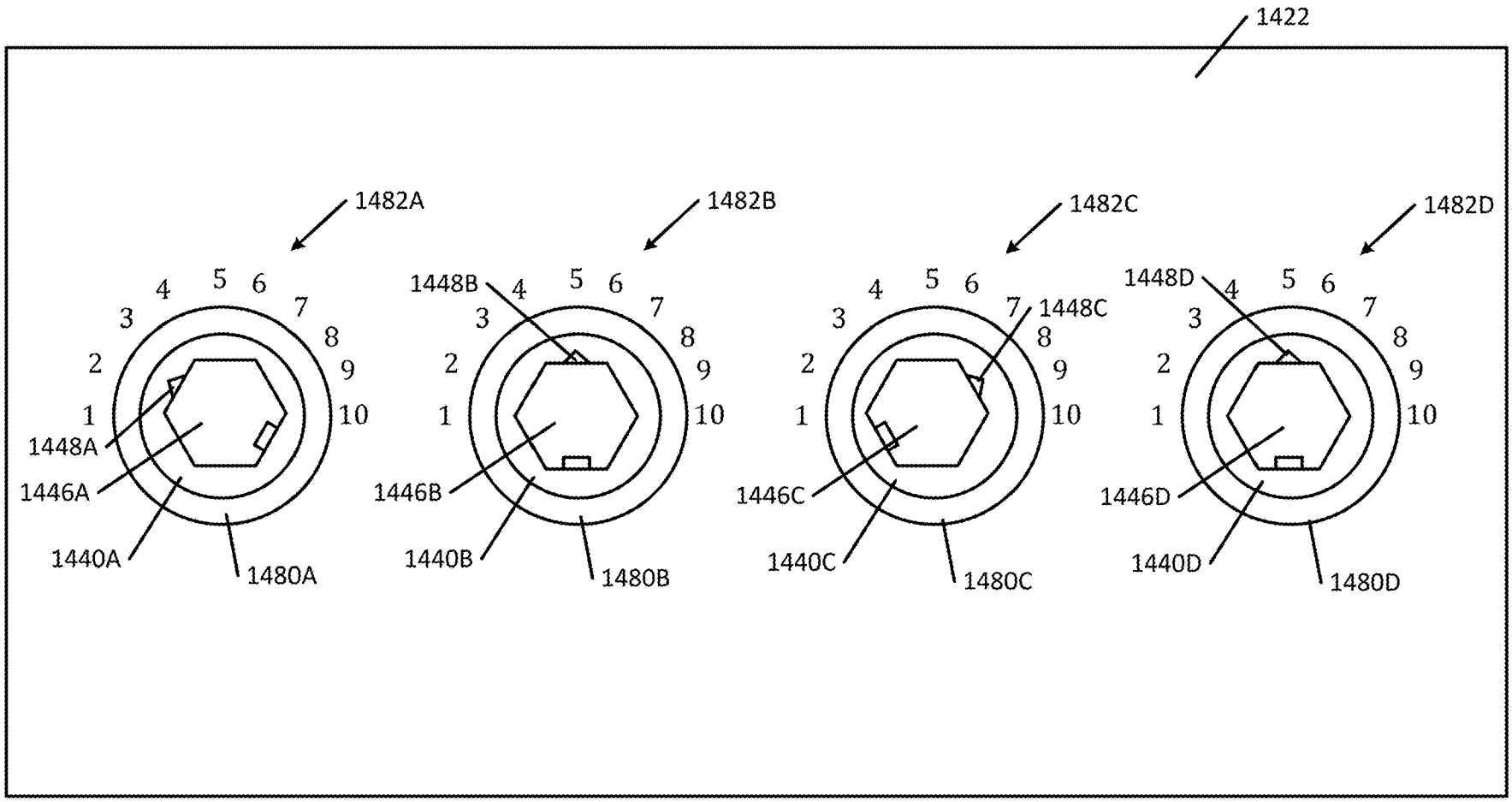
FIG. 14 is a schematic diagram of a portion of an example side panel and example axles according to embodiments described herein.

FIG. 14 is a schematic diagram of a portion of an example side panel 1422 and example axles 1440A, 1440B, 1440C, and 1440D. The side panel 1422 is an example of the side panels 222B and 222D. The side panel 1422 may be similar to the side panel 1322. The side panel 1422 includes apertures 1480A, 1480B, 1480C, and 1480D.

In this figure, ends of the axles 1440A, 1440B, 1440C, and 1440D are passing through the apertures 1480A, 1480B, 1480C, and 1480D. The axles 1440A, 1440B, 1440C, and 1440D may be similar to the previously described axle 1340.

In this example, the ends of the axles 1440A, 1440B, 1440C, and 1440D include keyed receivers 1446A, 1446B, 1446C, and 1446D with indicators 1448A, 1448B, 1448C, and 1448D, respectively, that point to values on markers 1482A, 1482B, 1482C, and 1482D. The sequential values of the indicators 1448A, 1448B, 1448C, and 1448D may represent the state of the adjustable firmness support layer 106 (which may be referred to as a personal firmness sequence). The personal firmness sequence may, for example, specify different firmness values for an individual's legs, hips, torso, shoulders, and head. The personal firmness sequence may be more or less granular depending on the number of individually controllable rotatable assemblies included in the implementation.

In some implementations, individuals may determine and record their personal firmness sequences. In some implementations, a software application may help an individual determine their personal firmness sequence. For example, the software application may prompt the user for various information such as their height, weight, age, gender, preferred sleeping position (e.g., side, back, stomach), and injuries or pressure points. This information may then be used to determine appropriate firmness levels for the individual along the length of the mattress and a corresponding personal firmness sequence.

In some implementations, an array of pressure sensors may be used to determine a personal firmness sequence. The array of pressure sensors may be embedded within a layer of the mattress, such as the comfort layer 102 or the transition layer 104. The sensors may record pressure at various positions on the mattress when an individual is reclining on the mattress. Based on those measurements (and in some implementations the previously discussed information provided by the individual), a personal firmness sequence may be determined.

Figure 15:
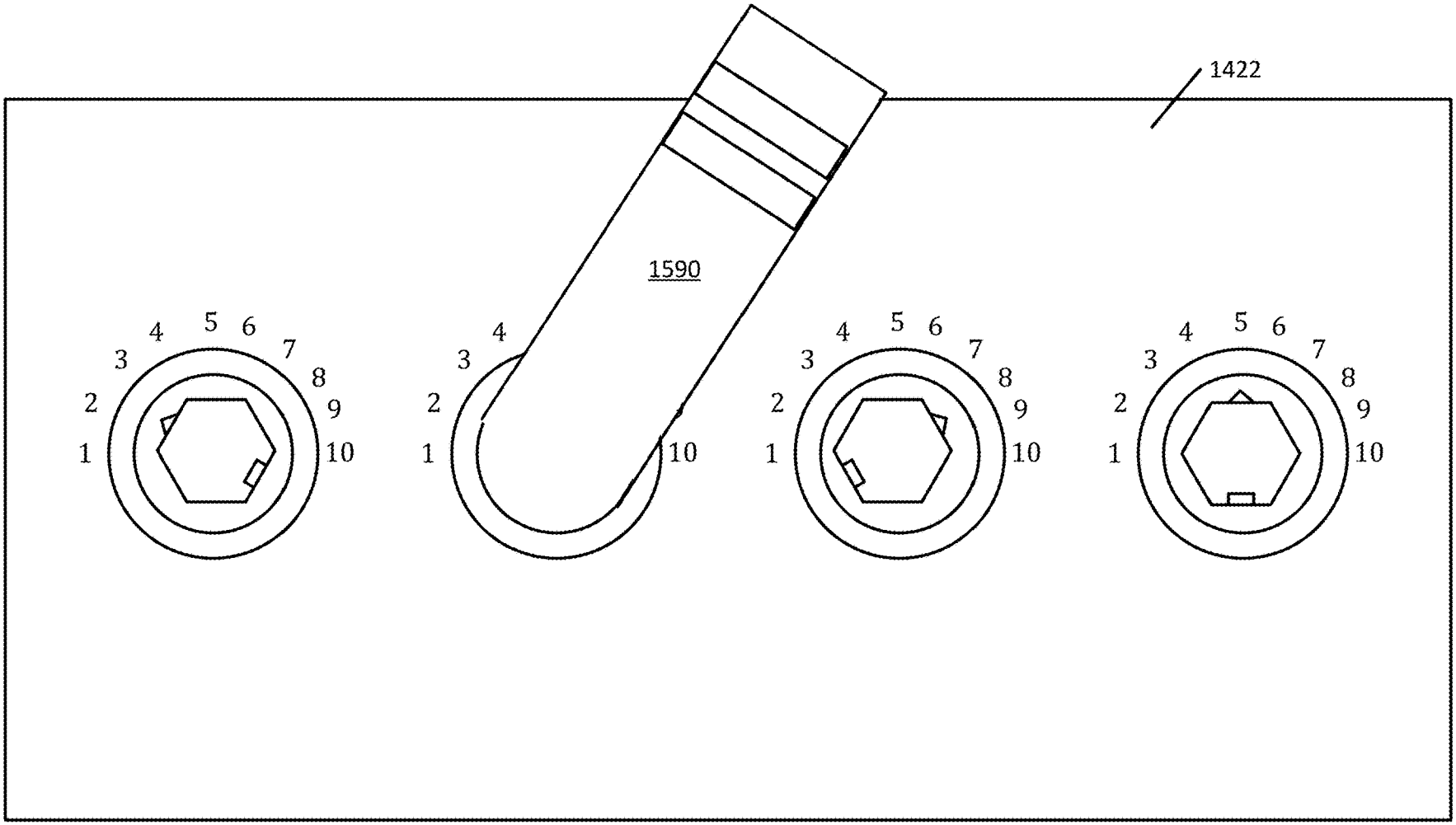
FIG. 15 is a schematic diagram of the example side panel and an example adjustment tool according to embodiments described herein.

FIG. 15 is a schematic diagram of the example side panel 1422 and an example adjustment tool 1590. The adjustment tool 1590 may be similar to a wrench and may have a first end with an insert that is shaped to fit into a keyed receiver of an axle and a second end with a handle (or grip). The length of the adjustment tool 1590 may provide leverage for the user to amplify the amount of force applied to an axle. In some implementations, a fabric cover of the adjustable firmness mattress 100 may include a pocket to hold the adjustment tool 1590.

Figure 16A:
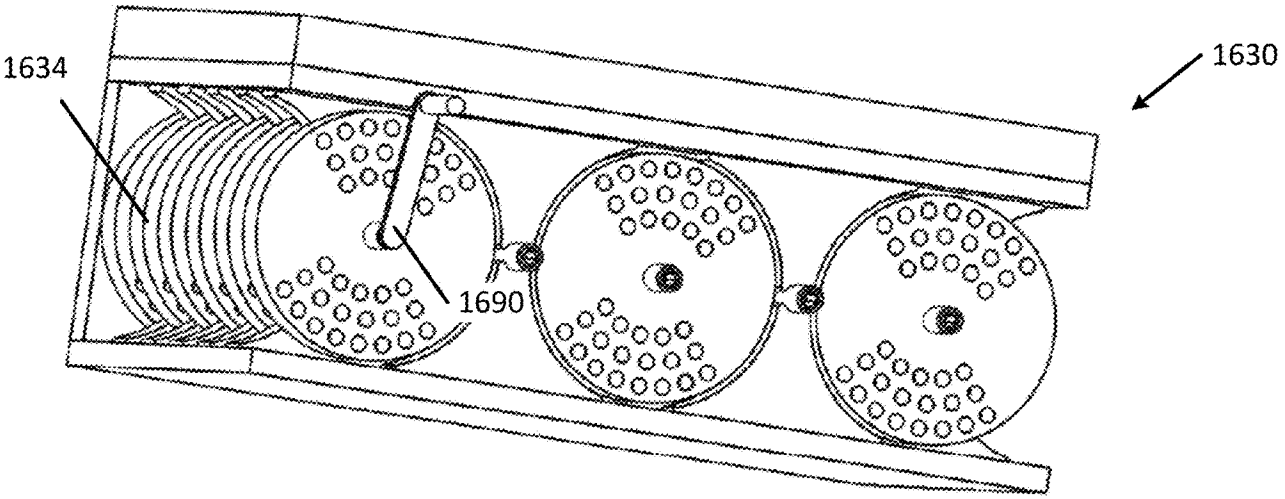
FIGS. 16A and 16B are schematic diagrams of an example internal adjustable firmness structure and an example adjustment tool.
Figure 16B:
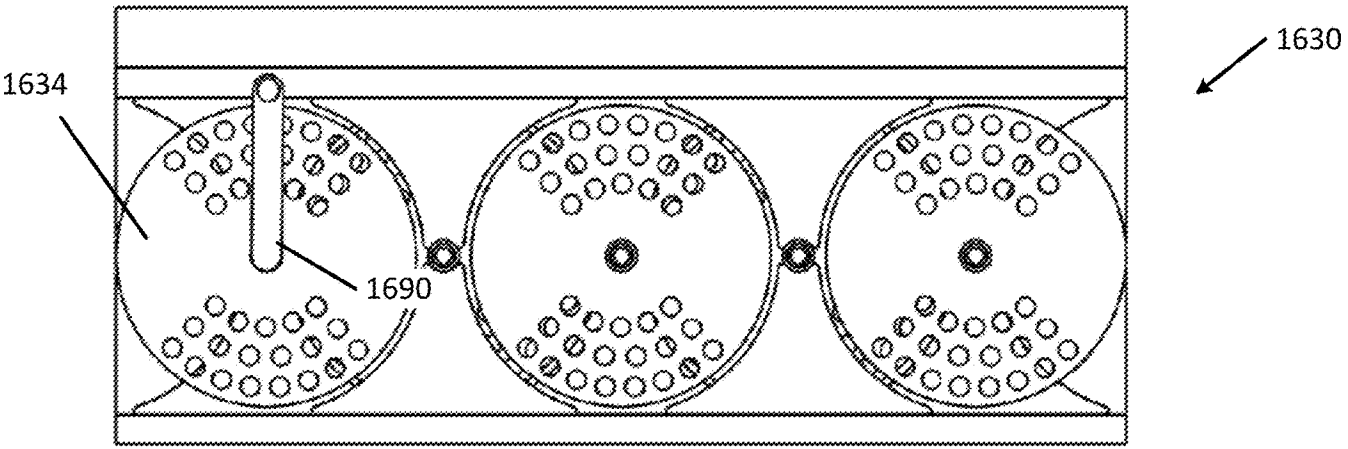

FIGS. 16A and 16B are schematic diagrams of an example internal adjustable firmness structure 1630 and an example adjustment tool 1690. FIG. 16A is a side view of the internal adjustable firmness structure 1630 and FIG. 16B is an orthographic projection view of the internal adjustable firmness structure 1630.

The example internal adjustable firmness structure 1630 may be similar to the previously described internal adjustable firmness structure 230, and the adjustment tool 1690 is an example of the adjustment tool 1590. Here, the adjustment tool 1690 is attached to a keyed receiver of an axle of a rotatable assembly 1634 of the internal adjustable firmness structure 1630. The adjustment tool 1690 includes a handle that sticks out in a direction parallel to the axle of the rotatable assembly 1634, which may make it easier for an individual to grab and use to rotate the rotatable assembly 1634.

Figure 17:
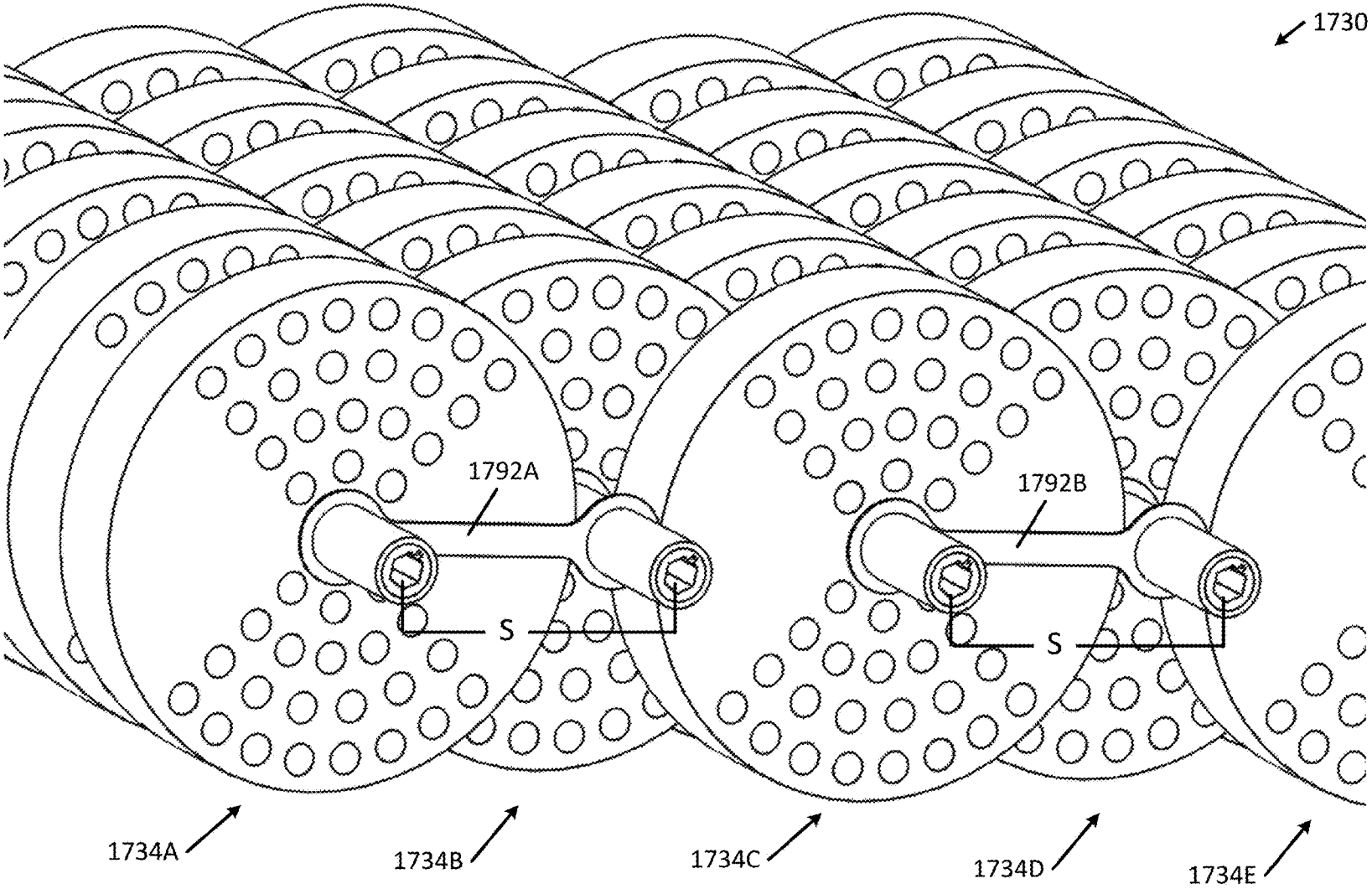
FIG. 17 is schematic diagrams of a portion of an example internal adjustable firmness structure that includes linkage structures according to embodiments described herein.

FIG. 17 is a schematic diagram of a portion of an example internal adjustable firmness structure 1730 that includes linkage structures 1792A and 1792B. The internal adjustable firmness structure 1730 may be similar to the previously described internal adjustable firmness structure 430.

As shown in FIG. 17, the portion of the internal adjustable firmness structure 1730 includes rotatable assemblies 1734A, 1734B, 1734C, 1734D, and 1734E (referred to collectively as rotatable assemblies 1734). The rotatable assemblies 1734 may be similar to the rotatable assembly 334. The internal adjustable firmness structure 1730 may include additional rotatable assemblies that are not shown in FIG. 16.

In this example, adjacent rotatable assemblies are coupled together by linkage structures. Here, the linkage structure 1792A couples the rotatable assemblies 1734A and 1734B; and the linkage structure 1792B couples the rotatable assemblies 1734C and 1734D. Although not shown in this figure, some implementations include additional linkage structures that couple other of the rotatable assemblies. The linkage structures 1792A and 1792B may include loops or other structures that may at least partially surround the axles of the rotatable assemblies and an elongate member that joins the loops. In some implementations, the linkage structures include additional loops and elongate members and are coupled to more than two rotatable assemblies. The linkage structures 1792A and 1792B may be formed from a material such as plastic or rubber. The linkage structures 1792A and 1792B prevent adjacent rotatable assemblies from moving apart from one another. For example, the linkage structures 1792A and 1792B may maintain a spacing (S) between adjacent rotatable assemblies.

Figure 18:
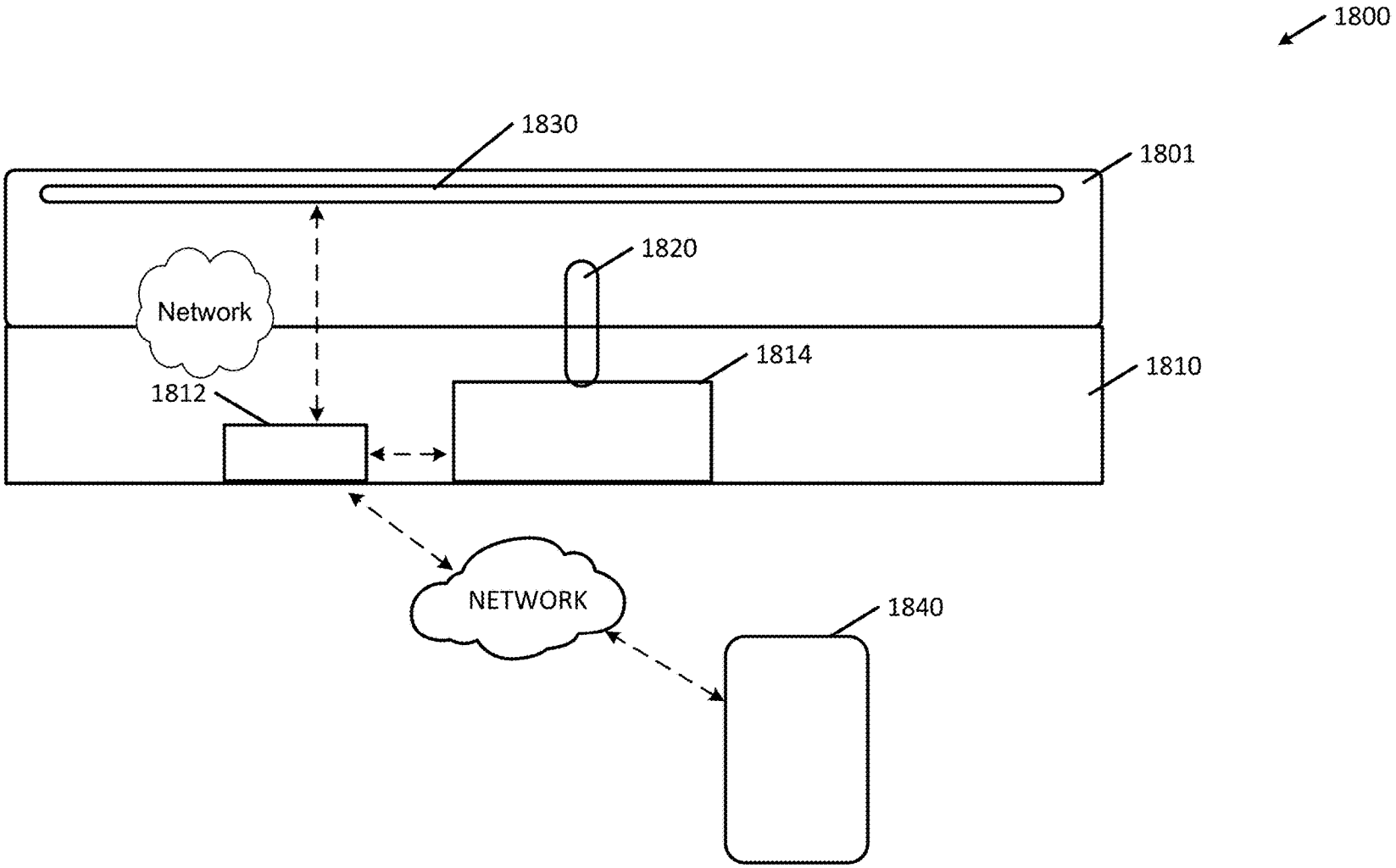
FIG. 18 illustrates an example motor-controlled adjustable firmness mattress system according to embodiments described herein.

FIG. 18 illustrates an example motor-controlled adjustable firmness mattress system 1800. The motor-controlled adjustable firmness mattress system 1800 includes an adjustable firmness mattress 1801, a foundation 1810, a transmission assembly 1820, a sensor assembly 1830, and a computing device 1840. The adjustable firmness mattress 1801 may be similar to the adjustable firmness mattress 100.

The foundation 1810 is a physical platform that supports the adjustable firmness mattress 1801 at a desired height. In some implementations, the foundation 1810 may include a box spring or another type of support for the adjustable firmness mattress 1801. In this example, the foundation 1810 includes a control system 1812 and a motor assembly 1814.

The transmission assembly 1820 is a device that transmits power from the motor assembly 1814 to one or more rotatable assemblies of the adjustable firmness mattress 1801. For example, the transmission assembly 1820 may include one or more pulleys. The pulleys may be individually controlled and may wrap around axles of the rotatable assemblies to deliver power from the motor assembly 1814 to rotate the rotatable assemblies.

The control system 1812 may include a computing device that can send control signals to activate or deactivate the motor assembly 1814 to adjust the rotatable assemblies. The control system 1812 may also communicate with the sensor assembly 1830 to receive various measurements, such as pressure measurements. Based on the received measurements, the control system 1812 may determine adjustments to make to the rotatable assemblies of the adjustable firmness mattress 1801. In some implementations, the control system 1812 does not activate the motor assembly 1814 for specific rotatable assemblies if pressure measurements associated with the rotatable assembly exceed a threshold level (e.g., to prevent damage to the motor assembly 1814, transmission assembly 1820, or rotatable assemblies caused by operating when an individual is reclining on the adjustable firmness mattress 1801).

The sensor assembly 1830 may include, for example, an array of pressure sensors. In some implementations, the sensor assembly 1830 may also include other types of sensors such as temperature sensors. For example, the sensor assembly 1830 may also include rotational or positional sensors associated with one or more of the rotatable assemblies to determine the actual orientation of those rotatable assemblies. The rotational or positional sensors may, for example, include magnets and magnetic sensors or accelerometers or other components to determine position or orientation. Based on measurements from the rotational or positional sensors, the control system 1812 may activate or deactivate the motor assembly 1814 to alter the orientation of one or more of the rotatable assemblies. The sensor assembly 1830 may communicate with the control system 1812, the computing device 1840, or both.

The computing device 1840 can be any type of computing device including a mobile computing device, such as a smartphone or smartwatch. The computing device 1840 may include memory that stores instructions for an application that, when executed by a processor of the computing device 1840, can communicate with the control system 1812 over a network. The application may send instructions to the control system 1812 that cause the control system 1812 to activate the motor assembly 1814 to rotate one or more of the rotatable assemblies of the adjustable firmness mattress 1801.

The application may also cause the computing device 1840 to generate and output a user interface through which an individual may input instructions to adjust the rotatable assemblies.

Although not shown in this figure, some embodiments of the foundation 1810 include additional components such as a heating system or cooling system that may be controlled by one or both of the control system 1812 or the computing device 1840.

Although the foundation 1810 is shown as a flat foundation here, in some implementations the foundation 1810 is an adjustable bed foundation that allows repositioning of one or more regions of the adjustable firmness mattress 1801 (e.g., raising the head or feet ends of the adjustable firmness mattress 1801).

Figure 19:
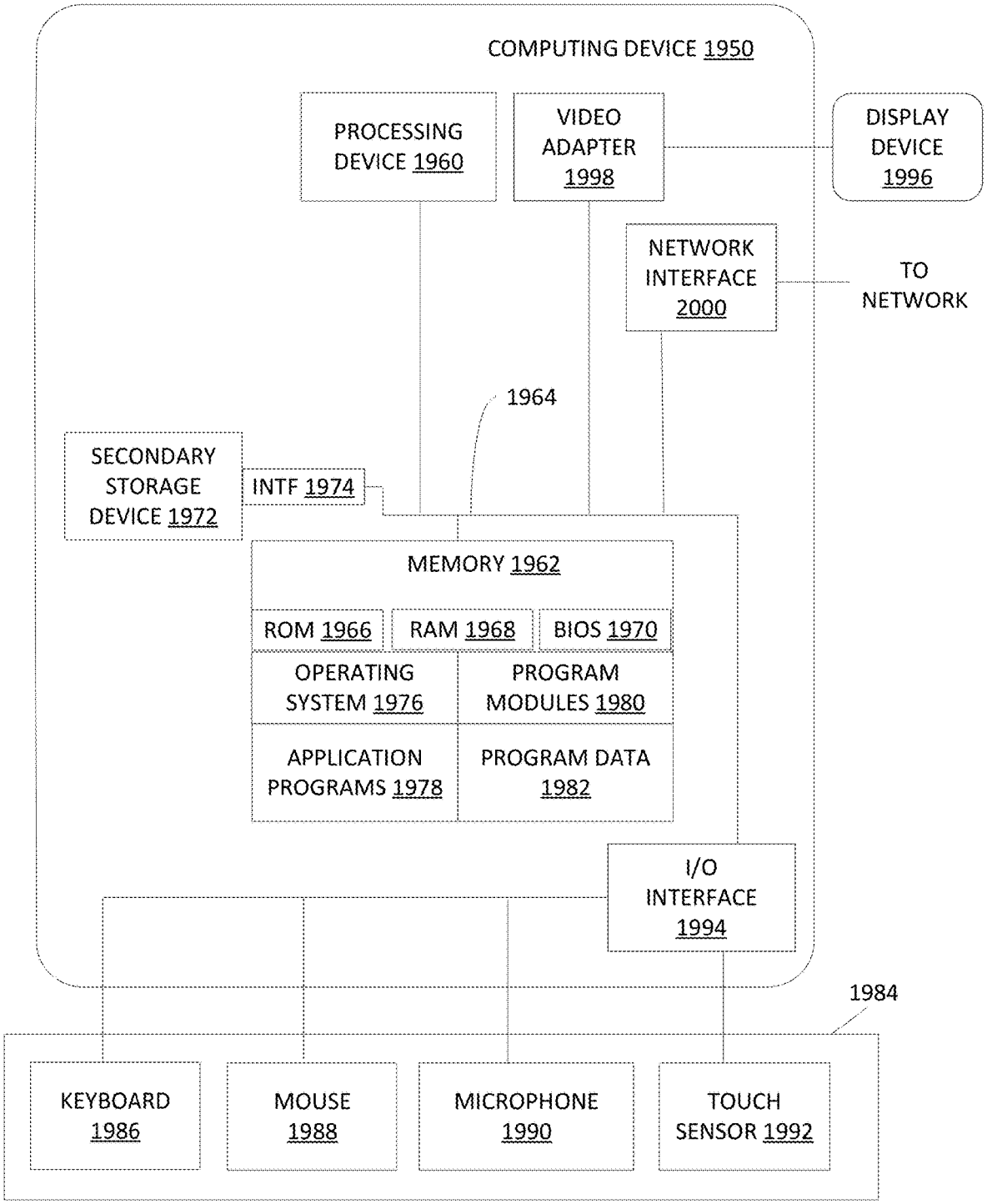
FIG. 19 illustrates an example architecture of a computing device, which can be used to implement aspects according to the present disclosure according to embodiments described herein.

FIG. 19 illustrates an example architecture of a computing device 1950 that can be used to implement aspects of the present disclosure, including any of the plurality of computing devices described herein, such as the computing device 1840, a computing device of the control system 1812, or any other computing devices that may be utilized in the various possible embodiments.

The computing device illustrated in FIG. 19 can be used to execute the operating system, application programs, and software modules described herein.

The computing device 1950 includes, in some embodiments, at least one processing device 1960, such as a central processing unit (CPU). A variety of processing devices are available from a variety of manufacturers, for example, Intel or Advanced Micro Devices. In this example, the computing device 1950 also includes a system memory 1962, and a system bus 1964 that couples various system components including the system memory 1962 to the processing device 1960. The system bus 1964 is one of any number of types of bus structures including a memory bus, or memory controller; a peripheral bus; and a local bus using any of a variety of bus architectures.

Examples of computing devices suitable for the computing device 1950 include a desktop computer, a laptop computer, a tablet computer, a mobile computing device (such as a smartphone, an iPod® or iPad® mobile digital device, or other mobile devices), or other devices configured to process digital instructions.

The system memory 1962 includes read only memory 1966 and random access memory 1968. A basic input/output system 1970 containing the basic routines that act to transfer information within computing device 1950, such as during start up, is typically stored in the read only memory 1966.

The computing device 1950 also includes a secondary storage device 1972 in some embodiments, such as a hard disk drive, for storing digital data. The secondary storage device 1972 is connected to the system bus 1964 by a secondary storage interface 1974. The secondary storage devices 1972 and their associated computer readable media provide nonvolatile storage of computer readable instructions (including application programs and program modules), data structures, and other data for the computing device 1950.

Although the example environment described herein employs a hard disk drive as a secondary storage device, other types of computer readable storage media are used in other embodiments. Examples of these other types of computer readable storage media include magnetic cassettes, flash memory cards, digital video disks, Bernoulli cartridges, compact disc read only memories, digital versatile disk read only memories, random access memories, or read only memories. Some embodiments include non-transitory computer-readable media. Additionally, such computer readable storage media can include local storage or cloud-based storage.

A number of program modules can be stored in secondary storage device 1972 or system memory 1962, including an operating system 1976, one or more application programs 1978, other program modules 1980 (such as the software engines described herein), and program data 1982. The computing device 1950 can utilize any suitable operating system, such as Microsoft Windows™, Google Chrome™ OS or Android, Apple OS, Unix, or Linux and variants and any other operating system suitable for a computing device. Other examples can include Microsoft, Google, or Apple operating systems, or any other suitable operating system used in tablet computing devices.

In some embodiments, a user provides inputs to the computing device 1950 through one or more input devices 1984. Examples of input devices 1984 include a keyboard 1986, mouse 1988, microphone 1990, and touch sensor 1992 (such as a touchpad or touch sensitive display). Other embodiments include other input devices 1984. The input devices are often connected to the processing device 1960 through an input/output interface 1994 that is coupled to the system bus 1964. These input devices 1984 can be connected by any number of input/output interfaces, such as a parallel port, serial port, game port, or a universal serial bus. Wireless communication between input devices and the interface 1994 is possible as well, and includes infrared, BLUETOOTH® wireless technology, 802.11a/b/g/n, cellular, ultra-wideband (UWB), ZigBee, or other radio frequency communication systems in some possible embodiments.

In this example embodiment, a display device 1996, such as a monitor, liquid crystal display device, projector, or touch sensitive display device, is also connected to the system bus 1964 via an interface, such as a video adapter 1998. In addition to the display device 1996, the computing device 1950 can include various other peripheral devices (not shown), such as speakers or a printer.

When used in a local area networking environment or a wide area networking environment (such as the Internet), the computing device 1950 is typically connected to the network through a network interface 2000, such as an Ethernet interface or WiFi interface. Other possible embodiments use other communication devices. For example, some embodiments of the computing device 1950 include a modem for communicating across the network.

The computing device 1950 typically includes at least some form of computer readable media. Computer readable media includes any available media that can be accessed by the computing device 1950. By way of example, computer readable media include computer readable storage media and computer readable communication media.

Computer readable storage media includes volatile and nonvolatile, removable and non-removable media implemented in any device configured to store information such as computer readable instructions, data structures, program modules or other data. Computer readable storage media includes, but is not limited to, random access memory, read only memory, electrically erasable programmable read only memory, flash memory or other memory technology, compact disc read only memory, digital versatile disks or other optical storage, magnetic cassettes, magnetic tape, magnetic disk storage or other magnetic storage devices, or any other medium that can be used to store the desired information and that can be accessed by the computing device 1950.

Computer readable communication media typically embodies computer readable instructions, data structures, program modules or other data in a modulated data signal such as a carrier wave or other transport mechanism and includes any information delivery media. The term "modulated data signal" refers to a signal that has one or more of its characteristics set or changed in such a manner as to encode information in the signal. By way of example, computer readable communication media includes wired media such as a wired network or direct-wired connection, and wireless media such as acoustic, radio frequency, infrared, and other wireless media. Combinations of any of the above are also included within the scope of computer readable media.

The computing device illustrated in FIG. 19 is also an example of programmable electronics, which may include one or more such computing devices, and when multiple computing devices are included, such computing devices can be coupled together with a suitable data communication network so as to collectively perform the various functions, methods, or operations disclosed herein.

Although this disclosure has primarily focused on rotatable assemblies that are oriented to rotate about a widthwise axis, other implementations are possible. For example, the rotatable assemblies may be oriented to rotate about a lengthwise axis. Rotatable assemblies that are oriented to rotate about a lengthwise axis, for example, may allow for individual adjustment of firmness for two individuals who share a mattress.

Embodiments are possible in which the rotatable assemblies are oriented in any direction that is orthogonal to the depth (top-to-bottom) direction of the mattress. Embodiments are possible that include multiple layers of rotatable assemblies, in which the rotatable assemblies in one layer are oriented to rotate about a lengthwise axis and the rotatable assemblies of another layer are oriented to rotate about a widthwise axis.

In some implementations, an adjustable firmness layer includes regions of constant firmness and regions of adjustable firmness. For example, the adjustable firmness layer may include rotatable assemblies that are oriented to rotate about widthwise axes and are disposed in a middle portion lengthwise of the adjustable firmness region (e.g., the region that would likely be supporting the hips and torso of a reclining individual).

Some implementations include rotatable assemblies that include a single compressible element that spans the entire (or substantially entire) width of the mattress. In these embodiments, the rotatable assemblies are not interleaved.

Some implementations include rotatable assemblies that have different cross-sectional shapes. As previously described, the rotatable assemblies may have circular cross-sections. The rotatable assemblies may also have a cross-section with a non-circular, constant width shape, such as a Reuleaux triangle.

The rotatable assemblies may also have square cross-sections. Beneficially, rotatable assemblies with square cross-sections may abut one another with little to no gap (e.g., to reduce any feel of unevenness or lumpiness). The rotatable assemblies may be re-oriented by lifting the rotatable assembly out of the adjustable firmness layer, rotating it, and placing it back in the adjustable firmness layer. In these implementations, the transition layer may be removable so as to provide access to the rotatable assemblies. The sides of the rotatable assemblies may be color coded based on the provided level of firmness.

In some implementations, the rotatable assemblies include spherical compressible elements. The rotatable assemblies may be mounted on axles that rotate the orientation of the spheres. In some implementations, the spheres are arranged in a grid in which adjacent spheres are offset in both the lengthwise and widthwise directions. For example, the spheres may be arranged such that their edges touch or nearly touch along a diagonal direction. Some implementations include a first set of axles oriented to rotate about a widthwise direction and a second set of axles oriented to rotate about a lengthwise direction. These axles may be arranged such that the rows of spheres alternate between rotating about a lengthwise axis and about a widthwise axis.

In some implementations, the rotatable assemblies may include sheets of compressible material which are wrapped around the axle of the rotatable assemblies (e.g., like a spool). For example, one end of a sheet of material may be fixedly attached to an axle of the rotatable assembly and the other end may be fixed elsewhere. As the rotatable assembly is rotated, the material may be pulled tighter around the axle causing compression of the material and increasing the firmness of the rotatable assembly. As another example, one end of a sheet of material may be fixedly attached to an axle of the rotatable assembly and the other end of the material may be wrapped around another axle disposed in a substructure or elsewhere. In some implementations, the end of the material not attached to the rotatable assembly may be free (i.e., unattached). As the rotatable assembly is rotated, more or less (depending on the direction of rotation) of the material is wrapped around the axle of the rotatable assembly altering the firmness of the rotatable assembly.

In some implementations, the transition layer or comfort layer may be replaceable to alter the firmness, feel, or function of the mattress. For example, a fabric cover may include a zipper that allows access to the comfort layer or transition layer. These layers may then be removed and replaced. For example, a replacement transition layer may include sensors to evaluate pressure, sleep patterns, heart rate, temperature, or breathing.

Various techniques may be used to manufacture the components described herein. In some implementations, a mold is used to form one or more of the bridge assembly or support assembly. A liquified foam material may be poured into the mold and allowed to cure into the shape of the bridge assembly or support assembly. Different molds may be used for different size mattresses.

Likewise, the compressible elements may be formed in a mold. In some implementations, an axle is placed in the mold before the liquid foam material is poured into the mold. The compressible elements may then form around the axle to couple the compressible elements to the axle. The axle may include shapes or cutouts in which the foam material may further bond. In some implementations, the mold may include structures to create apertures in regions of the compressible elements. These structures may, for example, include hollow tubes (e.g., PVC rods) that are positioned within the mold. The mold may include various alignment components to control the position of these structures (and the apertures formed thereby).

Although the examples in this disclosure primarily relate to a mattress, the technology described herein may also be included in other structures to provide for adjustable firmness. For example, chairs, including office chars, couches and other furniture, car seats, pillows, and cushions may include similar technologies.

The various embodiments described above are provided by way of illustration only and should not be construed to limit the disclosure. Those skilled in the art will readily recognize various modifications and changes that may be made without following the example embodiments and applications illustrated and described herein, and without departing from the true spirit and scope of this disclosure.

What is claimed is:

1. A rectangular shaped adjustable firmness mattress that extends lengthwise from a head end to a foot end, widthwise from a first side to a second side, and depth-wise from a top side to a bottom side, the mattress comprising:

an adjustable firmness support layer disposed between the bottom side of the mattress and the top side of the mattress, the adjustable firmness support layer including:

a plurality of rotatable assemblies, wherein the plurality of rotatable assemblies includes a first rotatable assembly and a second rotatable assembly, the first rotatable assembly including a first plurality of compressible elements that are mounted on a first central axle and the second rotatable assembly including a second plurality of compressible elements that are mounted on a second central axle, the first plurality of compressible elements interleaved with the second plurality of elements a bridge assembly disposed between the at least one rotatable assembly and the top side of the mattress; and a support assembly disposed between the at least one rotatable assembly and the bottom side of the mattress.

2. The mattress of claim 1, wherein the central axle of the first rotatable assembly is oriented widthwise, the first plurality of compressible elements having an orientation-specific firmness.

3. The mattress of claim 2, wherein the first rotatable assembly is configured to rotate about the long axis of the first central axle, changing the orientation of the first plurality of compressible elements.

4. The mattress of claim 3, wherein the first plurality of compressible elements are cylindrical and include first portions and second portions, the first portions having different material properties than the second portions.

5. The mattress of claim 4, wherein the first portions are formed from a first foam material and the second portions are formed from a second foam material.

6. The mattress of claim 4, wherein the first portions include apertures that alter the compressibility of the first portions.

7. The mattress of claim 4, wherein the first portions span at least ninety degrees along the compressible elements' perimeters and the second portions span at least ninety degrees along the compressible elements' perimeters, wherein changes in the orientation of the compressible elements change which of the first portions and the second portions are closer to the top side of the mattress.

8. The mattress of claim 4, wherein the first central axle passes through mounting apertures disposed at centers of the first plurality of compressible elements and is configured to transfer rotations of the first central axle to the first plurality of compressible elements.

9. The mattress of claim 8, wherein the first plurality of compressible elements include coupling elements that are disposed around the mounting apertures and configured to couple to the first central axle, the coupling elements are star shaped and formed from a more rigid material than the rest of the compressible elements.

10. The mattress of claim 4, wherein the first plurality of compressible elements are mounted along the first central axis and spaced apart by at least a thickness of the compressible elements.

11. The mattress of claim 2, wherein the first central axle includes a braided metal sleeve surrounding a foam material.

12. The mattress of claim 2, wherein an end of the first central axle includes a receiver, the receiver being configured to receive an adjustment tool that is usable to rotate the first central axle.

13. A rectangular shaped adjustable firmness mattress that extends lengthwise from a head end to a foot end, widthwise from a first side to a second side, and depth-wise from a top side to a bottom side, the mattress comprising:

a comfort layer that includes a layer of padding;

an adjustable firmness support layer disposed between the bottom side of the mattress and the comfort layer the adjustable firmness support layer including a plurality of rotatable assemblies, wherein the plurality of rotatable assemblies includes a first rotatable assembly and a second rotatable assembly, the first rotatable assembly including a first plurality of compressible elements that are mounted on a first central axle and the second rotatable assembly including a second plurality of compressible elements that are mounted on a second central axle, the first plurality of compressible elements interleaved with the second plurality of elements; and a fabric covering that encloses the comfort layer and the support layer.

14. The mattress of claim 13, further comprising a rigid linkage structure that spans between the first rotatable assembly and the second rotatable assembly and wraps at least partially around the first central axle and the second central axle.

15. The mattress of claim 13, further including a low-friction material disposed between the first plurality of compressible elements and the second plurality of compressible elements.

16. The mattress of claim 13, wherein the adjustable firmness support layer further includes a support assembly disposed between the rotatable assemblies and the bottom side of the mattress, the support assembly having multiple support wedges shaped to fit between adjacent compressible elements and formed from a foam material that is more rigid than the compressible elements.

17. The mattress of claim 13, wherein the adjustable firmness support layer further includes a bridge assembly disposed between the rotatable assemblies and the comfort layer, the bridge assembly having multiple bridge wedges shaped to fit between adjacent compressible elements and formed from a foam material that is less rigid than the compressible elements.

18. A rectangular shaped adjustable firmness mattress that extends lengthwise from a head end to a foot end, widthwise from a first side to a second side, and depth-wise from a top side to a bottom side, the mattress comprising:

a comfort layer that includes a layer of padding;

an adjustable firmness support layer disposed between the bottom side of the mattress and the comfort layer the adjustable firmness support layer including:

a plurality of rotatable assemblies, the rotatable assemblies including central axles with a plurality of compressible elements mounted along the central axles, the compressible elements having an orientation-specific firmness;

a bridge assembly disposed between the plurality of rotatable assemblies and the top side of the mattress and configured to distribute force applied to the top side of the mattress across multiple of the plurality of rotatable assemblies, the bridge assembly having multiple bridge wedges shaped to fit between adjacent compressible elements; and a support assembly disposed between the plurality of rotatable assemblies and the bottom side of the mattress, the support assembly having multiple support wedges shaped to fit between adjacent compressible elements and formed from a foam material that is more rigid than the compressible element; and a fabric covering that encloses the comfort layer and the support layer.

19. The mattress of claim 18, wherein the central axles include receivers configured to receive an adjustment tool that is usable to rotate the rotatable assemblies and the central axles include a rotatable pivot that allows for separate rotation of portions of the rotatable assemblies adjacent to the first side of the mattress from portions of the rotatable assemblies adjacent to the second side of the mattress.

* * * * *